US012680213B2

(12) United States Patent
Orndorff et al.

(10) Patent No.: US 12,680,213 B2
(45) Date of Patent: Jul. 14, 2026

(54) WASHING APPARATUS WITH MECHANICAL STABILIZER

(71) Applicant: The Procter & Gamble Company, Cincinnati, OH (US)

(72) Inventors: Jason Matthew Orndorff, Lawrenceburg, IN (US); Matthew Stephen Bauer, Loveland, OH (US); Hua Hu, Mason, OH (US); Scott Eugene Mizer, Loveland, OH (US); Kerry Lloyd Weaver, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 145 days.

(21) Appl. No.: 18/637,824

(22) Filed: Apr. 17, 2024

(65) Prior Publication Data

US 2025/0327234 A1 Oct. 23, 2025

(51) Int. Cl.
*D06F 37/04* (2006.01)
*D06F 39/12* (2006.01)

(52) U.S. Cl.
CPC ..... *D06F 37/04* (2013.01); *D06F 39/12* (2013.01)

(58) Field of Classification Search
CPC ..... D06F 37/04; D06F 39/12
USPC ..... 68/142
See application file for complete search history.

(56) References Cited

U.S. PATENT DOCUMENTS

| | | | | |
|---|---|---|---|---|
| 3,954,241 | A * | 5/1976 | Carlson | A47B 91/16 248/188.8 |
| 7,421,956 | B1 * | 9/2008 | McCarthy | A47B 85/00 108/147.21 |
| 2002/0139909 | A1 | 10/2002 | Oyama et al. | |
| 2005/0116134 | A1 | 6/2005 | Lee et al. | |
| 2017/0241065 | A1 * | 8/2017 | Nakamoto | D06F 23/06 |

FOREIGN PATENT DOCUMENTS

| | | |
|---|---|---|
| DE | 1954924 U | 2/1967 |
| GB | 1039657 A | 8/1966 |

OTHER PUBLICATIONS

PCT Search Report and Written Opinion for PCT/US2025/022640 dated Jun. 2, 2025, 11 pages.

* cited by examiner

*Primary Examiner* — Tinsae B Ayalew
(74) *Attorney, Agent, or Firm* — Carolyn S. Powell; George H. Leal

(57) ABSTRACT

A washing apparatus having an apparatus base, and a housing carried by the apparatus base. At least three feet are attached to the apparatus base, and an activatable foot is disposed opposite the at least three feet. The activatable foot is a spring-loaded foot that, when released, is pushed downward such that the foot engages with the floor. The activatable foot is attached to a leg that is movable within a cavity of the housing. A locking cam engages the leg and ensures that there is sufficient frictional engagement between the leg and a sidewall of the cavity such that during use of the washing apparatus, the activatable foot does not move up/down when engaged with the floor. The washing apparatus, when in use, is level and stabilized while the locking cam is engaged with the leg which helps to reduce vibration and noise.

20 Claims, 17 Drawing Sheets

WASHING APPARATUS WITH MECHANICAL STABILIZER

FIELD

The present disclosure relates generally to washing apparatuses, and more specifically, to a washing apparatus with a mechanical stabilizer to stabilize the washing apparatus when in use.

BACKGROUND

Many residents of urban dwellings are confronted with the problem of accomplishing the same household chores as their suburban counterparts in a fraction of the living space. Not all urban dwellings have a dedicated space for doing laundry or automatic dishwashing. Due to convenience, many residents do their dishes in the kitchen and their laundry in the kitchen or bathroom. Depending on the era in which the dwelling was built, there may or may not be dedicated plumbing or floor cabinet space for a washing apparatus for laundry and/or dishes. A stow away washing apparatus, such as an automatic dishwasher or a washing machine, may be moved from storage into a room in which it will be used, and then conveniently moved back to storage when not in use.

In the case of both automatic dishwashers and washing machines, each has rotatable parts which can lead to vibration and noise generation. For example, washing machines have a rotatable drum disposed within a stationary tub. The drum may be mounted on a generally horizontal or vertical axis. During the operation cycle of the washing machine, the drum may rotate about the axis. When the laundry is wet and unevenly distributed within the drum, the imbalance of mass within the drum can result in vibrations that generate appreciable forces and may cause the washing machine to move.

Stow away washing apparatuses may be provided with one or more wheels to more conveniently enable moving. In use, the machine may rest on one or more of the wheels and one or more feet of the washing machine.

The floors of many urban dwellings are not precisely level, e.g., not a flat horizontal plane, consisting of low and/or high spots. This can make it challenging for the resident to find a place at which the washing apparatus can rest stably while being operated. If the washing apparatus is on a floor that is not sufficiently level, the washing apparatus may move laterally during operation and/or may not be stable. For large washing apparatuses that are designed to remain in one position within a room, the washing apparatus is typically leveled by adjusting four leveling feet. The leveling feet are typically attached to threaded screws that can be screwed in or out of a frame to alter the position of an individual leveling foot. The leveling feet are at the bottom of the machine. This solution is not practical for stow away washing apparatuses since the user finds it inconvenient to adjust the leveling feet at floor level beneath a somewhat heavy washing apparatus every time the washing apparatus is moved into the room in which it will be used.

With these limitations in mind, there is a continuing unaddressed need for a mechanism that can be easily operated to level and stabilize a stow away washing apparatus when the washing apparatus is moved into position for use.

The discussion of shortcomings and needs existing in the field prior to the present disclosure is in no way an admission that such shortcomings and needs were recognized by those skilled in the art prior to the present disclosure.

SUMMARY

Various embodiments solve the above-mentioned problems and provide methods and devices useful for easily leveling and stabilizing a stow away washing apparatus when the washing apparatus is moved into position for use. A mechanical stabilizer includes an activatable foot attached to a leg that translates within a cavity. The activatable foot when released, is pushed downward such that the foot engages with the floor. A locking cam engages the leg and ensures that there is sufficient frictional engagement between the leg and a sidewall of the cavity such that during use, the activatable foot does not move up/down which stabilizes the washing apparatus and helps reduce the vibration and noise.

The washing apparatus includes an external housing carried by an apparatus base, and the mechanical stabilizer also carried by the apparatus base. The mechanical stabilizer includes a housing having sidewalls extending from the apparatus base. The housing includes the cavity, which has a first opening, a ceiling disposed superjacent the first opening, and at least one cavity sidewall disposed between the ceiling and the first opening. The cavity has a second opening disposed between the ceiling and the first opening.

The washing apparatus, when configured as a washing machine, further comprises a tub defining a fluid containment envelope, wherein the tub is disposed above the apparatus base. A drum is positioned within the tub and is rotatable relative to the tub about an axis of rotation that is within about 20 degrees of horizontal relative to the apparatus base.

At least three feet are attached to the apparatus base, and the activatable foot is disposed opposite the at least three feet. The activatable foot includes a foot base connected to the leg. The leg has a long axis and is movably disposed within the cavity in the housing generally along the long axis of the leg. A spring or similar device is disposed between the leg and the ceiling of the cavity. So, the activatable foot may be spring-loaded, pneumatically actuated, hydraulically actuated, electrically actuated, combinations thereof, or the like.

A cam is disposed adjacent the second opening of the cavity. The cam is pivotably attached to the housing and comprises a lever portion and an engagement portion. The engagement portion extends into the second opening. The engagement portion comprises a profiled engagement surface such that when engaged under no load on the activatable foot, the engagement surface applies a first force to the leg thereby pushing the leg into the at least one cavity sidewall. In contrast, when the engagement surface is engaged under load on the activatable foot, the engagement surface applies a second force to the leg thereby pushing the leg into the at least one cavity sidewall, and wherein the second force is greater than the first force.

As noted previously, the washing apparatus of the present disclosure is movable. To facilitate movement of the washing apparatus, one or more handles may be provided on the external housing providing sufficient space for one or more users to grip the handle and lift/carry/pull the washing apparatus to a desired position. To further facilitate movement of the washing apparatus, a pair of center wheels are provided for stability. The pair of center wheels are off from a symmetry plane of the washing apparatus to avoid tipping over along a narrow direction of the washing apparatus.

Moreover, a pair of center wheels that are off from the symmetry plane provide stability and help to reduce the likelihood of the machine tipping over along a narrow direction of the machine.

Additionally, or independently thereof, the washing apparatus may comprise one or more wheels which allow the washing apparatus to be rolled to and from its in-use and storage locations. Preferably, the washing apparatus comprises more than one wheel, e.g., a pair of opposing wheels or two pairs of opposing wheels. Where multiple wheels are provided, preferably at least one of the wheels comprises a swivel caster capable of rotation about a swivel axis. Even more preferably, at least one of the wheels comprises an omni wheel as described herein.

The activatable foot may be comprised by one or more wheels. In such configurations, the foot base of the activatable foot may comprise one or more wheels which are attached to the leg. Alternatively, where one or more wheels are included, the one or more wheels may be retractable so that non-movable feet (excluding adjustable vertically) may provide support for the washing apparatus while in use.

These and other features, aspects, and advantages of various embodiments will become better understood with reference to the following description, figures, and claims.

BRIEF DESCRIPTION OF THE DRAWINGS

Many aspects of this disclosure can be better understood with reference to the following figures, which illustrate examples according to various embodiments.

Figure 1:
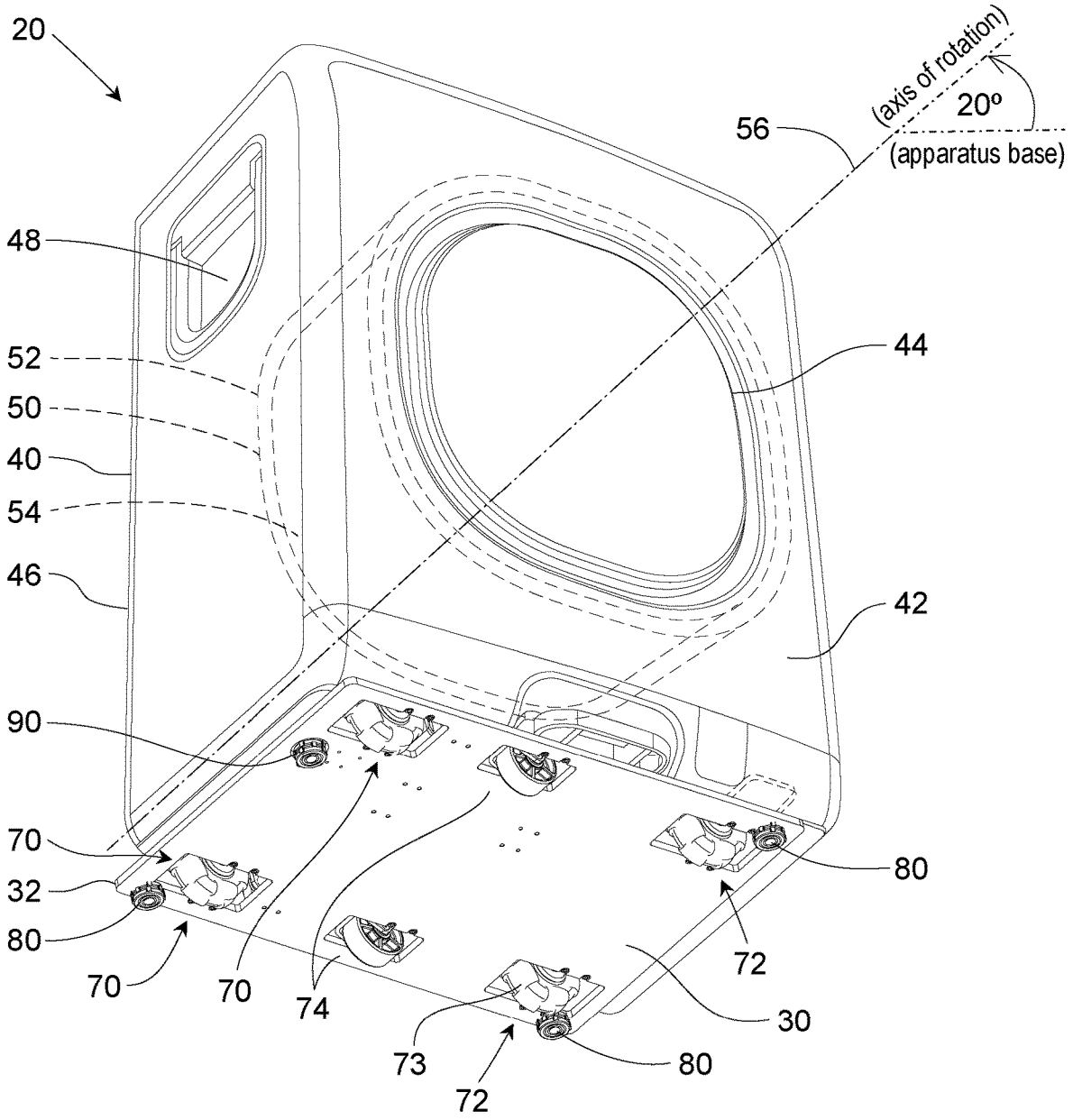
FIG. 1 is a bottom perspective view of a washing apparatus with a mechanical stabilizer configured to level and stabilize a stow away washing apparatus when the washing apparatus is moved into position for use.

It should be understood that the various embodiments are not limited to the examples illustrated in the figures.

DETAILED DESCRIPTION

Introduction and Definitions

This disclosure is written to describe the invention to a person having ordinary skill in the art, who will understand that this disclosure is not limited to the specific examples or embodiments described. The examples and embodiments are single instances of the invention which will make a much larger scope apparent to the person having ordinary skill in the art. Unless defined otherwise, all technical and scientific terms used herein have the same meaning as commonly understood by the person having ordinary skill in the art. It is also to be understood that the terminology used herein is for the purpose of describing examples and embodiments only, and is not intended to be limiting, since the scope of the present disclosure will be limited only by the appended claims.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features. The examples and embodiments described herein are for illustrative purposes only and that various modifications or changes in light thereof will be suggested to the person having ordinary skill in the art and are to be included within the spirit and purview of this application. Many variations and modifications may be made to the embodiments of the disclosure without departing substantially from the spirit and principles of the disclosure. All such modifications and variations are intended to be included herein within the scope of this disclosure. For example, unless otherwise indicated, the present disclosure is not limited to particular materials, reagents, reaction materials, manufacturing processes, or the like, as such can vary. It is also to be understood that the terminology used herein is for purposes of describing particular embodiments only and is not intended to be limiting. It is also possible in the present disclosure that steps can be executed in different sequences where logically possible.

All numeric values are herein assumed to be modified by the term "about," whether or not explicitly indicated. The term "about" generally refers to a range of numbers that one of skill in the art would consider equivalent to the recited value (for example, having the same function or result). In many instances, the term "about" may include numbers that are rounded to the nearest significant figure.

In everyday usage, indefinite articles (like "a" or "an") precede countable nouns and noncountable nouns almost never take indefinite articles. It must be noted, therefore, that, as used in this specification and in the claims that follow, the singular forms "a," "an," and "the" include plural referents unless the context clearly dictates otherwise. Thus, for example, reference to "a support" includes a plurality of supports. Particularly when a single countable noun is listed as an element in a claim, this specification will generally use a phrase such as "a single." For example, "a single support."

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

In this specification and in the claims that follow, reference will be made to a number of terms that shall be defined to have the following meanings unless a contrary intention is apparent.

"Disposed on" or "carried by" refers to a positional state indicating that one object or material is arranged in a position adjacent to the position of another object or material. The term does not require or exclude the presence of intervening objects, materials, or layers.

"Align" or "aligned" or "aligning" means to place or to arrange in a straight line. Aligning edges of substrates, therefore, means arranging the substrates so that the edges in question extend along approximately the same line. It is to be appreciated that aligning edges of substrates can be accomplished in a variety of ways, including placing the substrates one on top of the other or side by side.

Washing Apparatus with Mechanical Stabilizer

A washing apparatus 20 is shown in FIG. 1. The washing apparatus 20 is configured as a front-loading washing machine. For user efficiency, a front-loading washing apparatus 20 can be practical. Alternatively, the washing apparatus 20 may be configured as a top loading washing machine. A front-loading or top loading washing apparatus 20 can be provided to be conveniently moveable so that the user can move the washing apparatus 20 to different locations within a dwelling.

The washing apparatus 20 comprises an apparatus base 30. An internal frame may be mounted to the apparatus base 30. The apparatus base 30 can be the bottom or a part of the internal frame that supports other components of the washing apparatus 20. Optionally, the apparatus base 30 can be part of an external housing 40 of the washing apparatus 20. The apparatus base 30 can have four corners 32. The four corners 32 can define a square, rectangle, trapezoid, or other four-sided polygon that is practical for supporting the components of the washing apparatus 20.

Above the apparatus base 30, the washing apparatus 20 can comprise a tub 50 defining a fluid containment envelope 52. When the washing apparatus 20 is configured as a washing machine, a drum 54 can be positioned within the tub 50. The drum 54 can be rotatable relative to the tub 50 about an axis of rotation 56. The axis of rotation 56 can be within about 20 degrees of horizontal relative to the apparatus base 30. An axis of rotation 56 that is tipped slightly relative to horizontal can be ergonomic for users to reach in and out of the washing apparatus 20 and can help provide for stability of the washing apparatus 20 when the drum 54 contains laundry articles and is rotating. The axis of rotation 56 can be within about 20 degrees, or within about 10 degrees, or within about 5 degrees above horizontal relative to the apparatus base 30. The axis of rotation 56 can be horizontal relative to apparatus base 30.

The washing apparatus 20 can have a front face 42 through which the drum 54 is accessed by a user. The front face 42 may include a hinged door 44 that can be open and closed to provide access to the interior of the drum 54. A rear face 46 is opposite the front face 42.

The drum 54 can have porous or perforated walls so that a washing liquor, wetting water, and rinse water, can be added and removed from the tub 50. The drum 54 can have a volume from about 20 L to about 70 L. A washing apparatus 20 having such a small drum 54 can be readily moveable about a user's dwelling by rolling it around on wheels 70, 72 and 74. Optionally, one or more of the wheels 70 are swivel casters capable of rotation about a swivel axis.

When the washing apparatus 20 is configured as a dishwasher, one or more impellers (water and/or motor propelled) may be positioned within the tub 50. One or more slidable racks may be provided within the tub 50 to facilitate loading and unloading of dishware. Similarly, the dishwasher may be rolled on wheels 70.

To facilitate movement of the washing apparatus 20, one or more handles may be provided on the external housing 40 providing sufficient space for one or more users to grip the handle and lift/carry/pull the washing apparatus 20. Additionally or independently thereof, the washing apparatus 20 may comprise a first pair of wheels 70, a second pair of wheels 72, and a third pair of wheels 74 which may allow the washing apparatus 20 to be rolled to and from its in-use and storage locations. In the following description, individual wheels within the first pair of wheels 70 may be referred to as first wheel 70*a* or first wheel 70*b*. Likewise, individual wheels within the second pair of wheels 72 may be referred to as second wheel 72*a* or second wheel 72*b*. Each of the respective wheels 70*a*, 70*b*, 72*a*, 72*b* may be generally referred to as wheel 73.

The first pair of wheels 70 can be positioned at a side, the front, or the rear of the apparatus base 30. The first pair of wheels 70 can operably support two of the four corners 32 of the apparatus base 30. The second pair of wheels 72 can be provided opposite the first pair of wheels 70. The second pair of wheels 72 can support the other two corners 32 of the apparatus base 30 independent of the first pair of wheels 70. The second pair of wheels 72 can be positioned at a side, the front, or the rear of the apparatus base 30. In describing the pairs of wheels, a particular named pair of wheels (e.g., the first pair or the second pair) is not specified as being at a particular location since it is not critical if the particular named pair is at the front, rear, or one of the sides of the washing apparatus 20. Rather, together, the first and second pairs of wheels 70, 72 define two of the edges of a polygon defined by the four wheels.

The first, second and third pairs of wheels 70, 72, 74 extend through the apparatus base 30 and are movable between an engaged position and a retracted position. In the engaged position, the third pair of wheels 74 and at least one of the first and second pairs of wheels 70, 72 are engaged (i.e., in contact) with the floor upon which the washing apparatus 20 is placed. This allows the washing apparatus 20 to be easily rolled into position.

The wheels 73 can be made of polymer for quiet and non-marking rolling on various common floor surfaces, such as tile, vinyl, wood, carpet, composite laminate, cork, and the like. Wheels 73 can also be made from polypropylene, polyurethane, acetal, and the like. Each wheel 73 can have a diameter from about 3 cm to about 8 cm. The frame and plate associated with the wheels 73 can be made of stamped metal such as plated steel or stainless steel. Alternatively, the frame and plate associated with the wheels 73 can be injection molded plastic. Optionally, each wheel 73 may be omni wheels providing omnidirectional movement. Omni wheels comprise a primary axis of rotation and along its circumference may comprise a plurality of rollers which have an axis of rotation generally perpendicular to the primary axis of rotation.

Wheels 74 extend down from the base about 3 mm more than the other wheels 70 and 72 so that at least these two wheels 74 will always be in contact with the floor when the machine is in the transport mode. Wheel pairs 70 and 72 may or may not be in contact with the floor when the machine is in the transport mode depending on which direction the machine is being pushed. Wheels 74 give the machine a fixed direction of movement (they do not act like a caster) and that direction of movement is parallel to the wide dimension of the machine base, meaning the machine can only be pushed in the side to side direction or pivoted about the machine's central vertical axis for steering. The purpose of wheels 74 is to prevent the user from translating the machine in the direction mostly parallel to the narrow dimension (front to back or vice versa) of the machine base. If the wheels of the machine permitted the machine to be translated (pushed) in the direction parallel to the narrow dimension of the machine base it is more likely to tip over if the wheels encounter some obstruction on the floor. In summary, the intended manner of moving the machine is to push it primarily in its side-to-side direction while inducing slight pivots as needed for steering.

A pair of center wheels 74 are linked to the first and second pairs of wheels 70, 72 to help facilitate movement of the first and second pairs of wheels 70, 72 between the engaged position and the retracted position. The pair of center wheels 74 are placed about the symmetry plane of the washing apparatus 20 and near the front and back edges to facilitate the translation and the rotation. The pair of center wheels 74 are off the symmetry plane so that the washing apparatus 20 can preferably rotate instead of tipping over when the washing apparatus 20 is pushed along the front to back direction. Each of the center wheels may be located near the center of one of the two long edges of the base. Each of the center wheels may comprise a rotational axis that is horizontal and perpendicular to the long lower edges of the base. In such configurations, the center wheels may have a fixed rotational axis with respect to the base, i.e., no ability to swivel. Each of the center wheels may be positioned so at least this pair of wheels is always contacting the floor when any wheels are in the engaged position. One purpose of the center wheels is to restrict the user to push the machine primarily in the direction parallel to the long dimension of the base to prevent tipping.

In the retracted position, the first, second and third pairs of wheels 70, 72, 74 are spaced from the floor. That is, the first and second pairs of wheels 70, 72 are not engaged with the floor in the retracted position. Instead, at least three feet 80 attached to the apparatus base 30 are now in contact with the floor while the first and second pairs of wheels 70, 72 are in the retracted position. Optionally, the feet 80 could be wheels. However, if the feet 80 are wheels, then a brake is used to lock the wheels in place while the washing apparatus 20 is in use. Alternatively, the first and second pairs of wheels 70, 72 could act as feet as well if provided with a brake to lock the first and second pairs of wheels 70, 72 in place.

The feet 80 are typically attached to threaded screws that can be screwed in or out of the apparatus base 30 to alter the height of an individual foot. Optionally, a portion of the at least three feet 80 are adjustable in height with respect to the apparatus base 30. As another option, a portion of the at least three feet 80 are fixed in height with respect to the apparatus base 30. As another yet option, none of the at least three feet 80 are adjustable in height with respect to the apparatus base 30.

To operate the washing apparatus 20, the first and second pairs of wheels 70, 72 may be placed in the retracted position and the apparatus base 30 makes contact with the floor via the at least three feet 80. While in operation, the washing apparatus 20 may vibrate, for example, as the drum 54 rotates. Vibration may be induced by a slight or gross imbalance of the load of laundry within the drum 54 during operation of the washing apparatus 20. In the case of the washing apparatus 20 configured as a dishwasher, vibration may be induced via the impeller(s) spinning within the tub 50. Depending on the nature of the imbalance, the washing apparatus 20 may tend to move in translation across the floor during operation, move about via twisting, or move in some combination of translation and twisting.

To help restrain such tendency for the washing apparatus 20 to move, it can be practical to employ an activatable foot 90 that makes contact with the floor while the first and second pairs of wheels 70, 72 are in the retracted position. The activatable foot 90 extends through the apparatus base 30 and helps to level the washing apparatus 20 while in use. The activatable foot 90 is preferably not a wheel. As will be described in greater detail below, the activatable foot 90 may be biased to extend toward the floor and to stabilize the machine with respect to the floor while the at least three feet 80 also make contact with the floor. The height of the activatable foot 90 may vary to compensate for a floor that is not precisely level. A washing apparatus 20 that is level and stabilized when in use helps to reduce vibration and noise.

Figure 2:
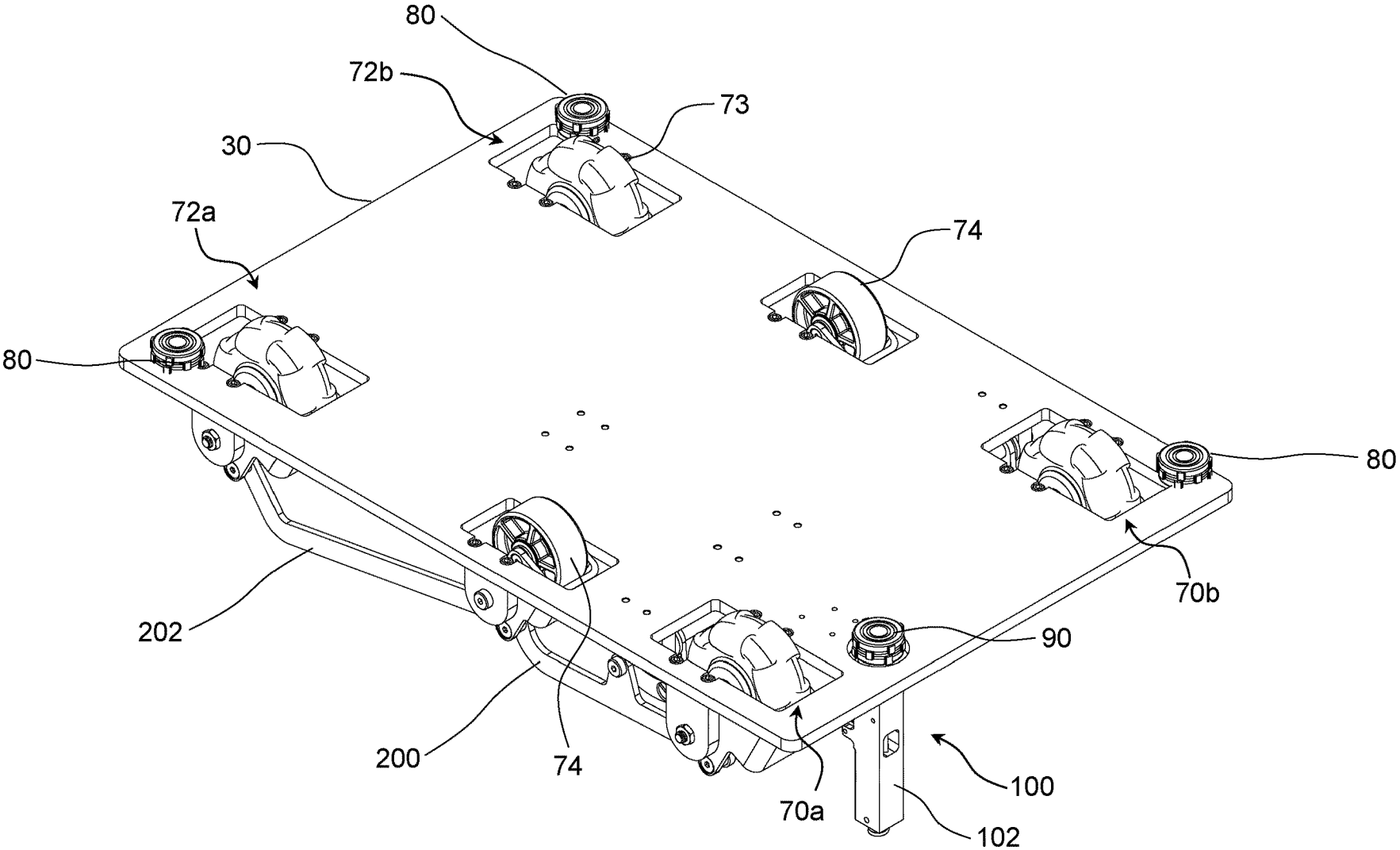
FIG. 2 is a bottom perspective view of the apparatus base for the washing apparatus illustrated in FIG. 1.

FIG. 2 is bottom perspective view of the apparatus base 30 for the washing apparatus 20 as shown in FIG. 1. The apparatus base 30 is carrying a mechanical stabilizer 100 that includes a housing 102 and the spring-loaded foot 90 as noted above. The activatable foot 90 is moveable within a cavity of the housing 102 and extends through the apparatus base 30.

On one side of the apparatus base 30, first wheel 70*a* is connected to a center wheel 74 on the same side via a linkage 200, and second wheel 72*a* on the same side is connected to the same center wheel 74 via a linkage 202. Likewise on the other side of the apparatus base 30, first wheel 70*a* is connected to a center wheel 74 on the same side via a linkage 200, and second wheel 72*b* on the same side is connected to the same center wheel 74 via a linkage 202. The center wheels 74 are respectively linked to the first and second pairs of wheels 70, 72 to help the first, second and third pairs of wheels 70, 72, 74 move in unison between the engaged position and the retracted position.

At three of the corners 32 of the apparatus base 30 are the at least three feet 80. As noted above, the at least three feet 80 are typically attached to threaded screws that can be screwed in or out of the apparatus base 20 to alter the height of an individual foot. Each foot 80 is on an outside edge of either first wheel 70*b*, second wheel 72*a* or second wheel 72*b*. The activatable foot 90 can be on an inside edge of first wheel 70*a*.

The center wheels 74 may be adjacent the center of the machine but are not required to be centered along the outer edges of the apparatus base 30. The center wheels 74 may be positioned closer to the first pair of wheels 70 and the activatable foot 90. Consequently, a length of the linkage 202 between the center wheels 74 and the second pair of wheels 72 may be longer than a length of the linkage 200 between the center wheels 74 and the first pair of wheels 70.

Figure 3:
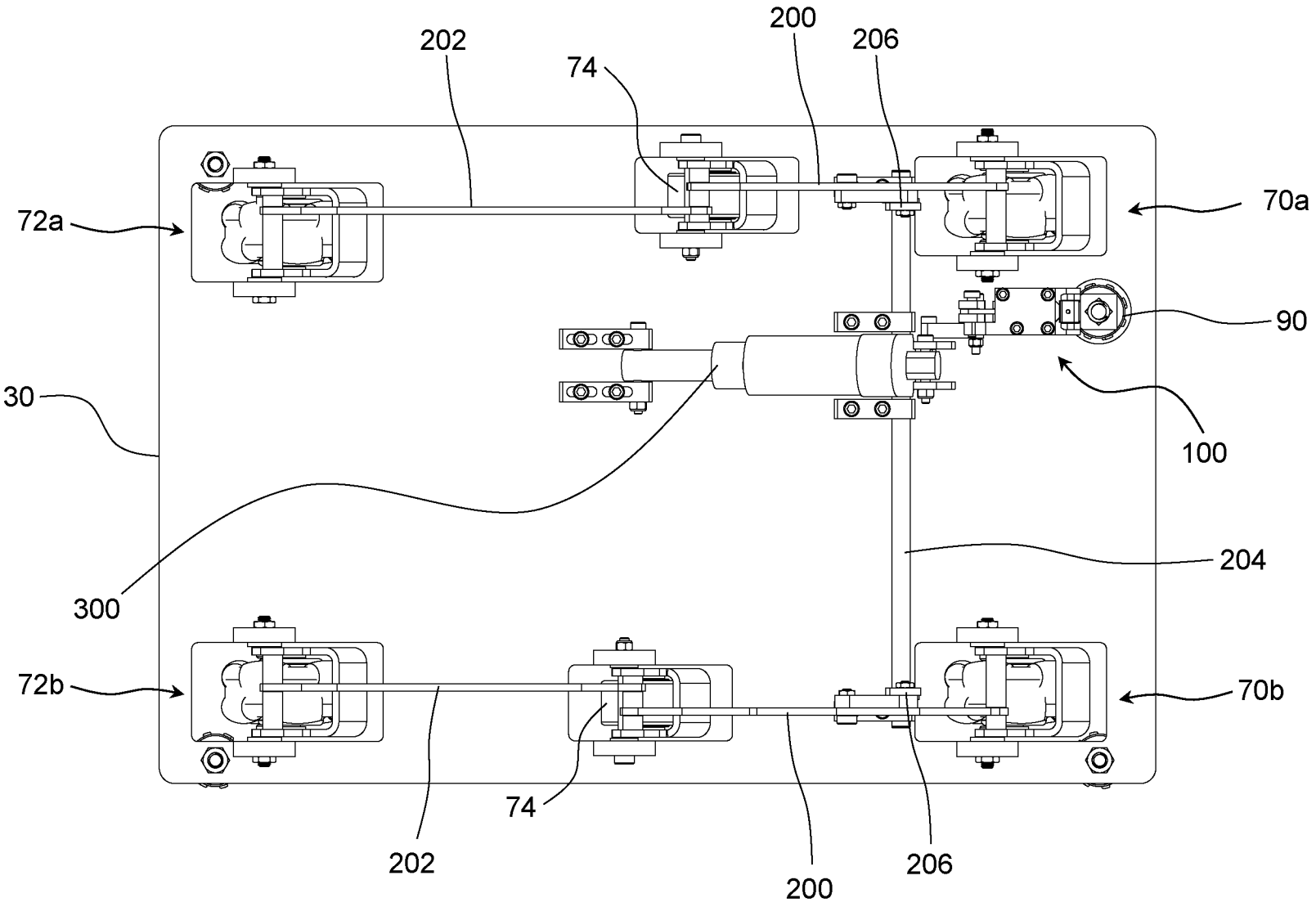
FIG. 3 is a top view of the apparatus base for the washing apparatus illustrated in FIG. 2.

FIG. 3 is a top view of the apparatus base 30 for the washing apparatus 20 illustrated in FIG. 2. Movement of the linkages 200, 202 on each side of the apparatus base 30 is controlled by an actuator 300 coupled to a rotating shaft 204. Opposing ends of the rotating shaft 204 are coupled to a respective rotating linkage arm 206 that in turn causes the first, second and third pairs of wheels 70, 72, 74 to move between the engaged position and the retracted position.

The actuator 300 may be mechanically, hydraulically, pneumatically, or electronically actuated. Actuation of the actuator 300 may be initiated by the user pressing a button on the washing apparatus 20. By pressing the button, the user can activate the actuator 300 to operate the mechanical stabilizer 100. Optionally, a touchscreen or a portion of a touch screen may be used to operate the mechanical stabilizer 100. The user can input an instruction to the washing apparatus 20 via the touchscreen to operate the mechanical stabilizer 100, possibly remotely or wirelessly or via an electromechanical device.

Preferably, the pair of center wheels 74 are in contact with the floor when the first and second pairs of wheels 70, 72 are in the engaged position. The respective first and second pairs of wheels 70, 72 may or may not touch the floor depending on the levelness of the floor.

Figure 4:
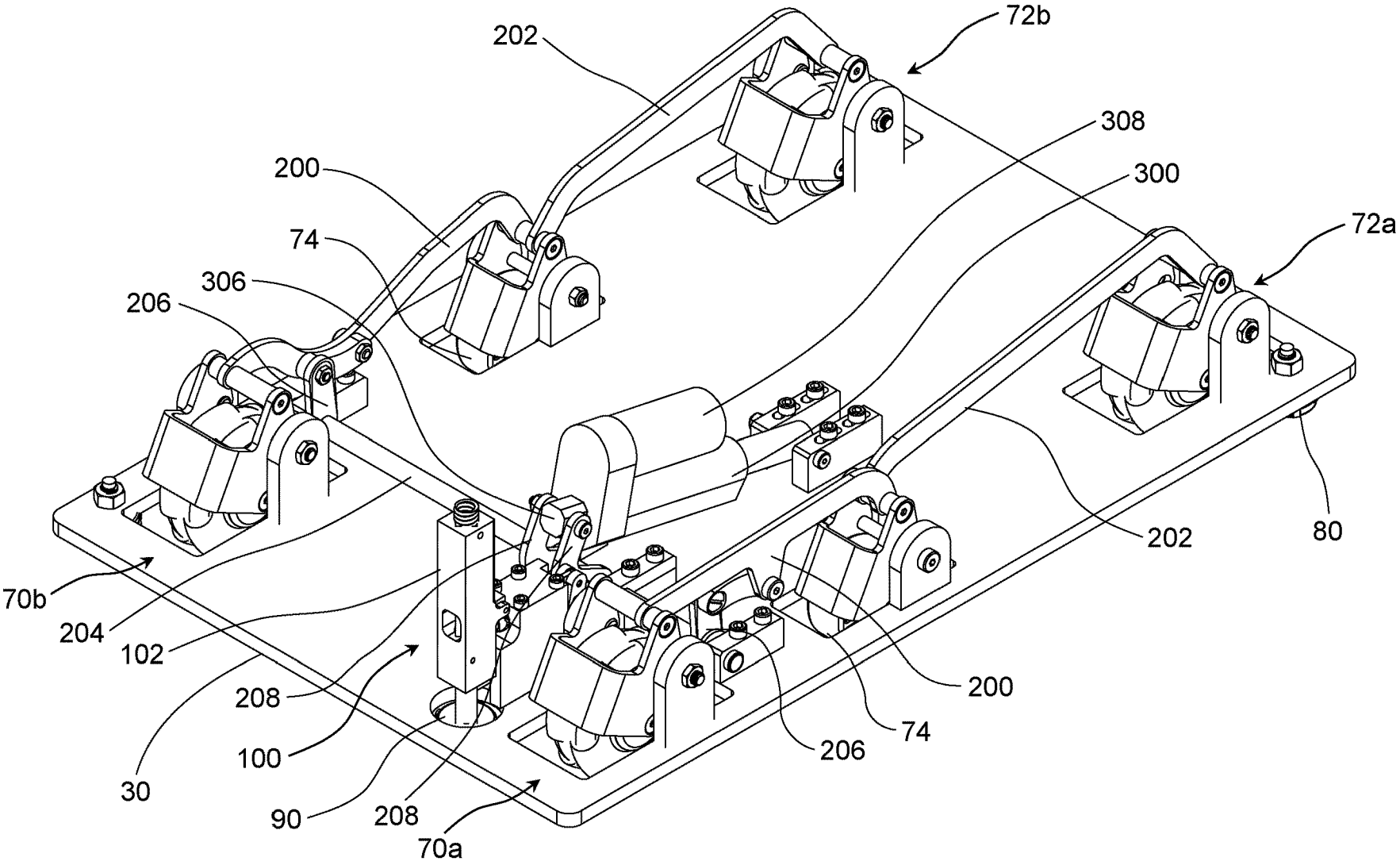
FIG. 4 is a left side upper perspective view of the apparatus base for the washing apparatus illustrated in FIG. 3.
Figure 5:
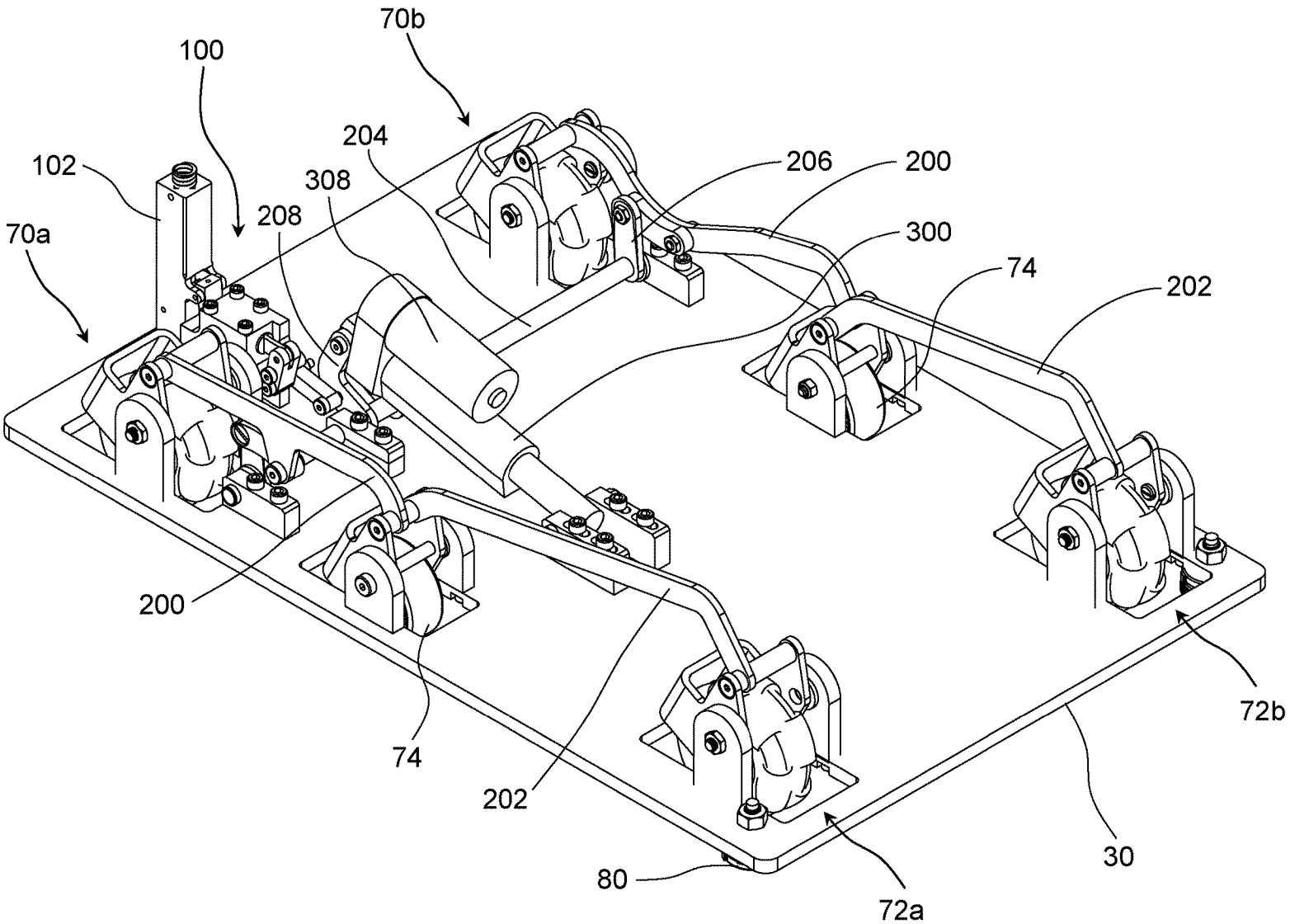
FIG. 5 is a right-side upper perspective view of the apparatus base for the washing apparatus illustrated in FIG. 3.

FIGS. 4 and 5 are respective left side and right side upper perspective views of the apparatus base 30 for the washing apparatus 20 illustrated in FIG. 2. An electric motor 308 is coupled to the actuator 300 to control movement thereof. Optionally, the actuator 300 may be air or hydraulicly controlled.

A tip of the actuator 306 is coupled to ends of a pair of rotating shaft arms 208. The opposing ends of the pair of rotating shaft arms 208 are coupled to the rotating shaft 204. Movement of the actuator tip 306 causes the rotating shaft 204 to rotate, which in turn causes linkages 200 and 202 to move. Rotation of the linkages 200, 202 causes the first, second and third pairs of wheels 70, 72, 74 to move between the engaged position and the retracted position.

Figure 6:
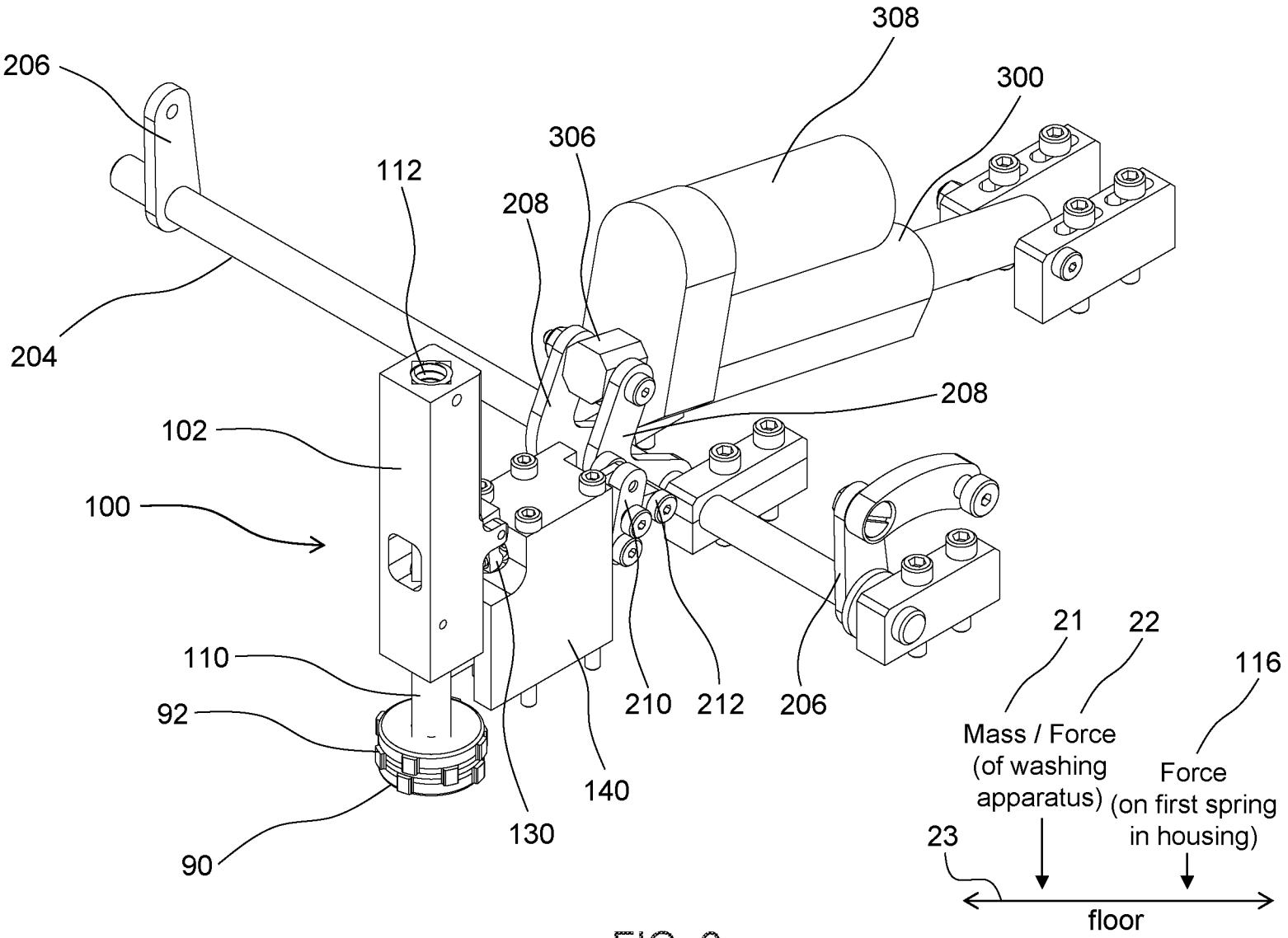
FIG. 6 is a partial left side perspective view of the mechanical stabilizer assembly illustrated in FIG. 4.

FIG. 6 is a partial left side perspective view of the mechanical stabilizer assembly illustrated in FIG. 4. The mechanical stabilizer 100 includes the housing 102 that carries the activatable foot 90. The activatable foot 90 includes a foot base 92 coupled to a leg 110 that moves up and down within a cavity in the housing 102. A range of travel of the leg 110 along its longitudinal axis is about 20 mm, and preferably 4 to 5 mm.

Where the activatable foot 90 is spring-loaded, a first spring 112 is positioned within the housing 102 to force the foot base 92 toward the floor. The washing apparatus 20 has a mass 21 that provides a downward force 22 toward the floor 23, and the first spring 112 is configured to apply a force 116 to the housing 102 that is from between about 40% to about 70% of the downward force 22 of the mass 21 of the washing apparatus 20.

A cam 130 is pivotably attached to the housing 102 and comprises a lever portion and an engagement portion. The housing 102 is coupled to a piston housing 140 that carries a piston that interfaces with the lever portion of the cam 130.

Piston linkages 210, 212 are coupled together between the piston housing 140 and the rotating shaft arms 208 that are coupled to the rotating shaft 204. Movement of the actuator tip 306 moves the rotating shaft arms 208, which in turn rotate the rotating shaft 204. Rotation of the rotating shaft 204 then causes the piston linkages 210, 212 to move. Movement of the piston linkages 210, 212 moves the piston within the piston housing 140 to make contact with the lever portion of the cam 130.

Figure 7:
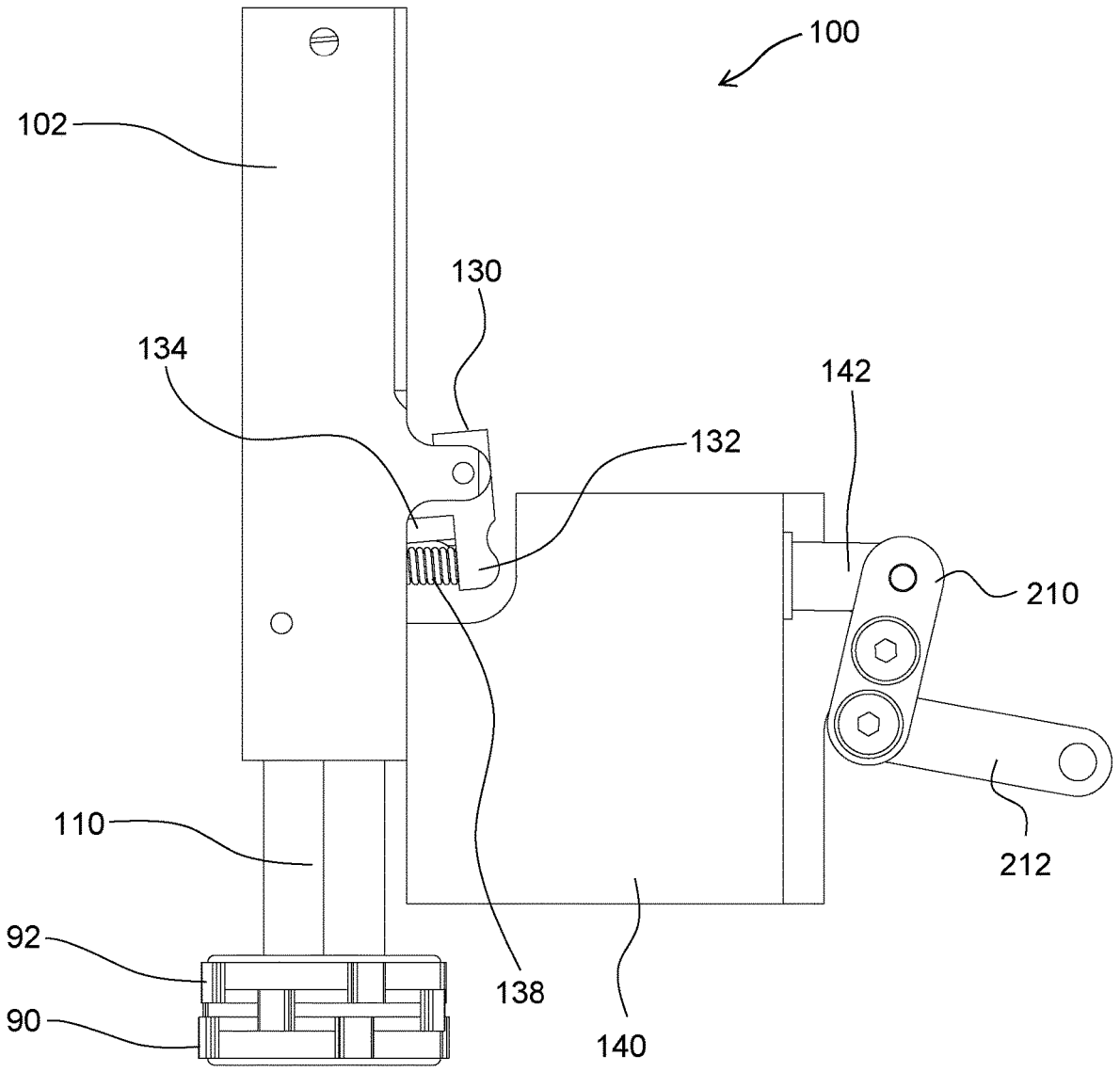
FIG. 7 is a side view of the mechanical stabilizer illustrated in FIG. 6.

FIG. 7 is a side view of the mechanical stabilizer 100 illustrated in FIG. 6. Piston linkage 210 is coupled to a piston shaft 142 that is coupled to the piston within the piston housing 140. As noted above, the cam 130 comprises a lever portion 132 and an engagement portion 134. The engagement portion 134 extends into the cavity within the housing 102 to engage the leg 110.

The cam 130 may also be referred to as a locking cam. The cam 130 is configured to engage the leg 110 and ensure that there is sufficient frictional engagement between the leg 110 and a sidewall of the cavity in the housing 102 such that during use of the washing apparatus 20, the foot base 92 does not move up/down when engaged with the floor.

The cam 130 may be biased by a pair of second springs 138 positioned between the housing 102 and the lever portion 132 of the cam 130. The pair of second springs 138 may be used as release springs for the cam 130.

Figure 8:
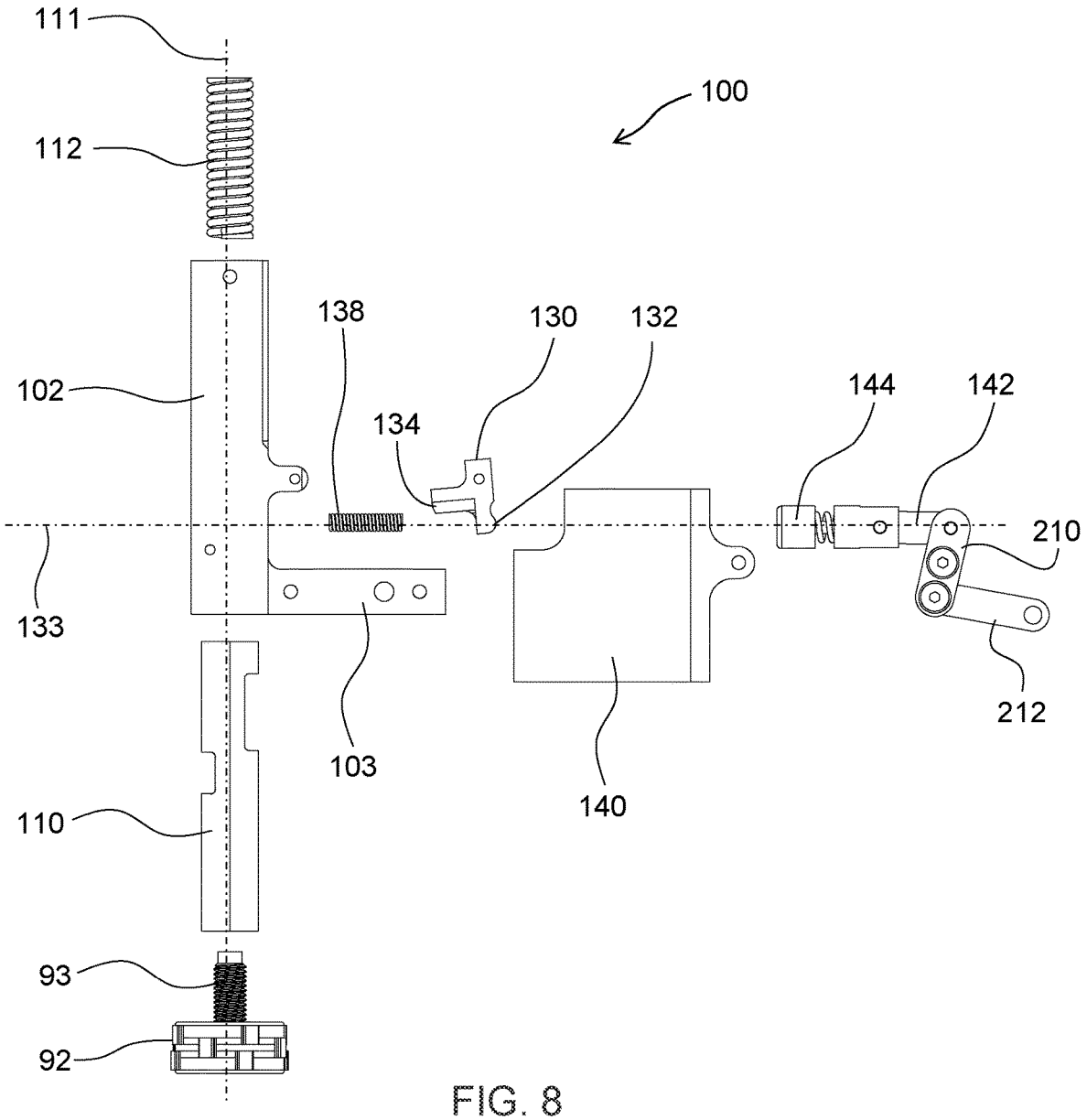
FIG. 8 is an exploded side view of the mechanical stabilizer illustrated in FIG. 7.

FIG. 8 is an exploded side view of the mechanical stabilizer 100 illustrated in FIG. 7. The foot base 92 may include a screw thread 93 that can be screwed in or out of a leg 110. The leg 110 has a long (i.e., longitudinal) axis 111 and is movably disposed generally along the long axis 111 within the cavity in the housing 102. A range of travel of the leg 110 along the long axis 111 is about 20 mm, and preferably 4 to 5 mm. The first spring 112 may be disposed between the leg 110 and a ceiling of the cavity. The first spring 112 is a compression spring that drives the leg 110 downward.

The housing 102 has an extension 103 that extends into the piston housing 140. The extension 103 is coupled to the piston housing 140. A piston 144 is coupled to a piston shaft 142 with a spring 143 disposed between the piston 144 and the piston shaft 142. The spring 143 allows the piston 144 to extend in length if needed so that that once contact is made between the cam 130 and the leg 110, the piston 144 can continue to compress as the first and second pairs of wheels 70, 72 reach a fully disengaged position. The piston shaft 142 is coupled to piston linkages 210, 212. The piston 144 is movably positioned within the piston housing 140 to make contact with the lever portion 132 of the cam 130. The cam 130 is pivotably coupled to the housing 102, and the pair of second springs 138 are disposed along a longitudinal axis 133 of the piston 144.

Figure 10:
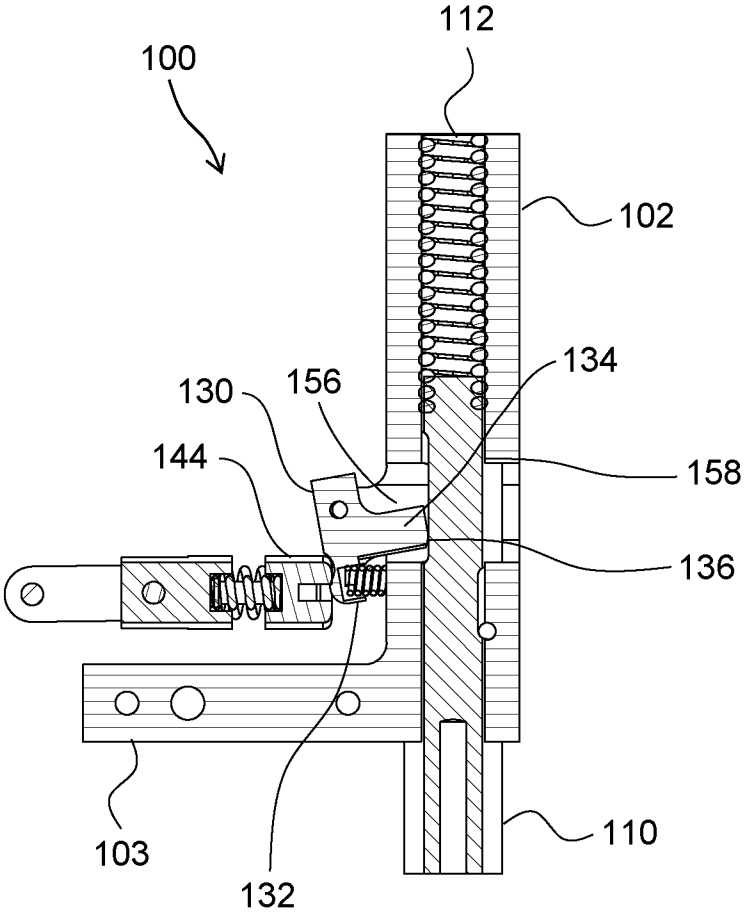
FIG. 10 is a partial cross-sectional view of the mechanical stabilizer illustrated in FIG. 7 with the cam engagement surface in a locked position.
Figure 9:
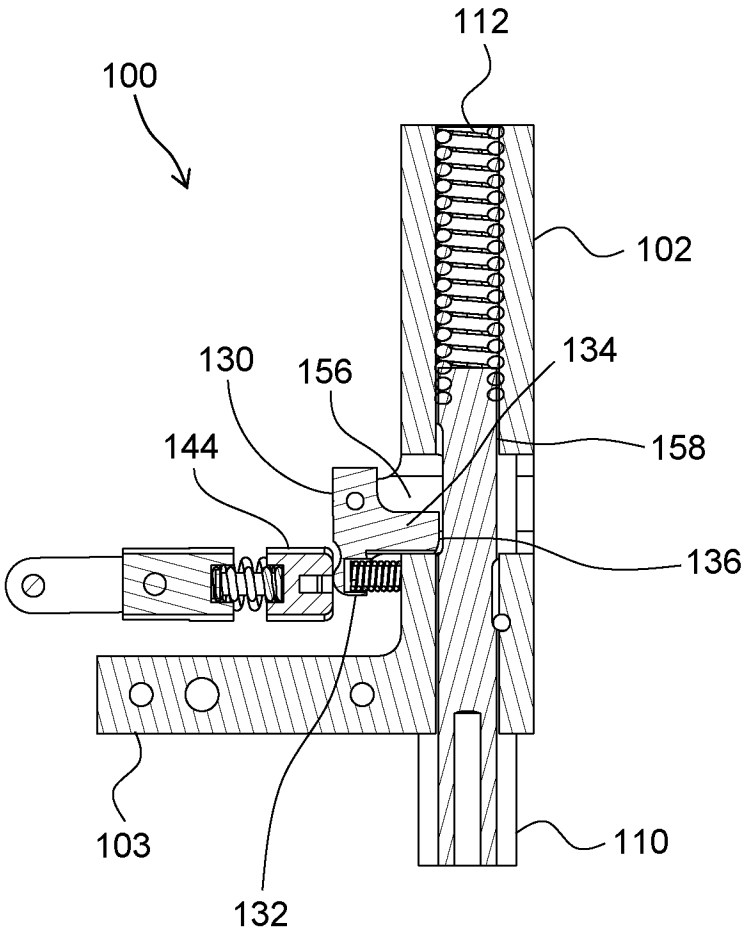
FIG. 9 is a partial cross-sectional view of the mechanical stabilizer illustrated in FIG. 7 with the cam engagement surface in an unlocked position.
Figure 22:
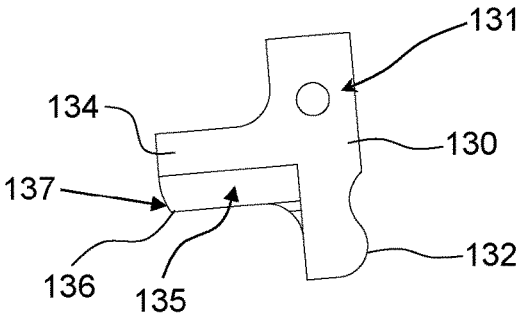
FIG. 22 is a side view of the cam illustrated in FIG. 11.
Figure 23:
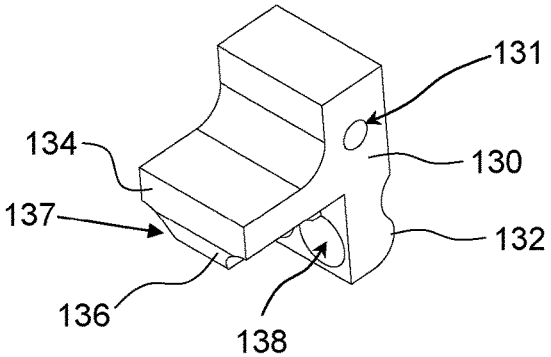
FIG. 23 is a front side upper perspective view of the cam illustrated in FIG. 11.

FIGS. 9 and 10 are partial cross-sectional views of the mechanical stabilizer 100 illustrated in FIG. 7. The engagement portion 134 of the cam 130 comprises a profiled engagement surface 136. The engagement surface 136 has a radius defining a curved edge 137 (shown in FIG. 22) that makes contact with the leg 110 that is moveably positioned within the housing 102.

The engagement surface 136 of the cam 130 is in an unlocked position in FIG. 9 and is in a locked position in FIG. 10. The unlocked position of the engagement surface 136 is based on the washing apparatus 20 being stowed away and not in use, whereas the locked position of the engagement surface 136 is based on the washing apparatus 20 being in a room in which it will be used. In the unlocked position, the engagement surface 136 of the cam 130 does not touch the leg 110. Consequently, a force is not applied to the leg 110 by the cam 130. However, as the cam 130 rotates to the locked position, the engagement surface 136 touches the leg 110.

Figure 24:
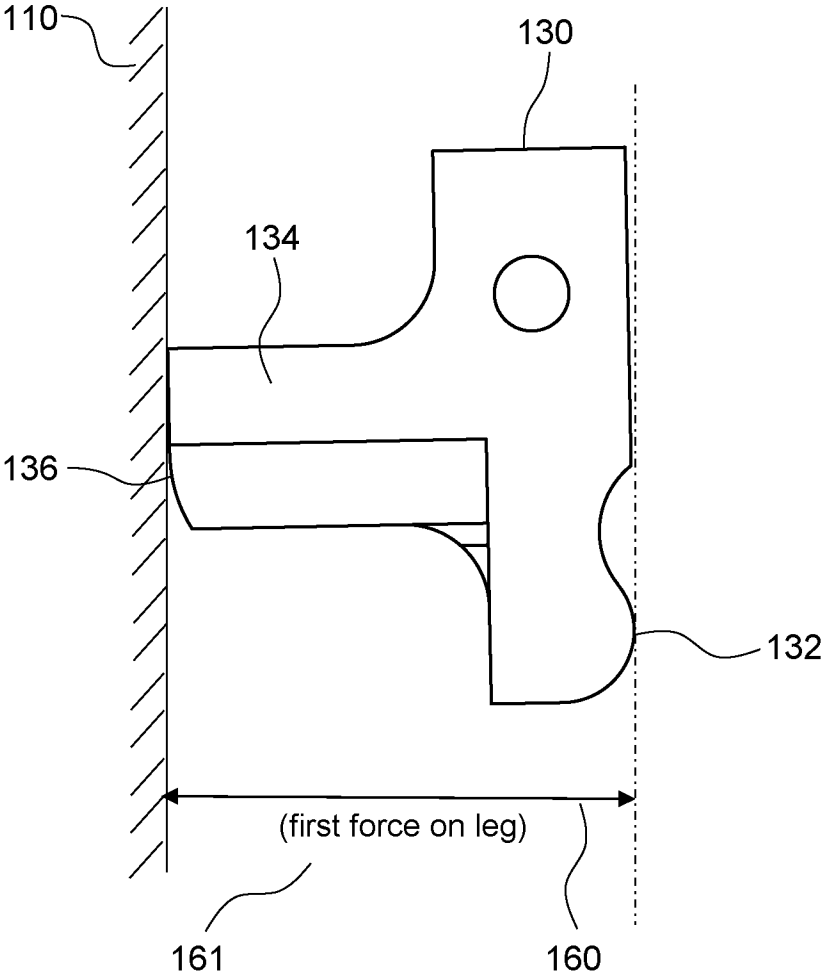
FIG. 24 is an enlarged side view of the cam illustrated in FIG. 10 making contact with the leg in a locked position with no load on the activatable foot.

If there is no load on the activable foot 90, then a first force 161 (shown in FIG. 24) is applied by the cam 130 to the leg 110 (shown in FIG. 24). This results in the leg 110 being pushed into a cavity sidewall within the housing 102. If there is a load on the activable foot 90, then a second force 165 (shown in FIG. 25) is applied by the cam 130 to the leg 110, where the second force 165 is greater than the first force 161. This also results in the leg 110 being pushed into the cavity sidewall within the housing 102, but the second force 165 pushes the leg 110 further up into the housing 102 as compared to the first force 161.

Figure 11:
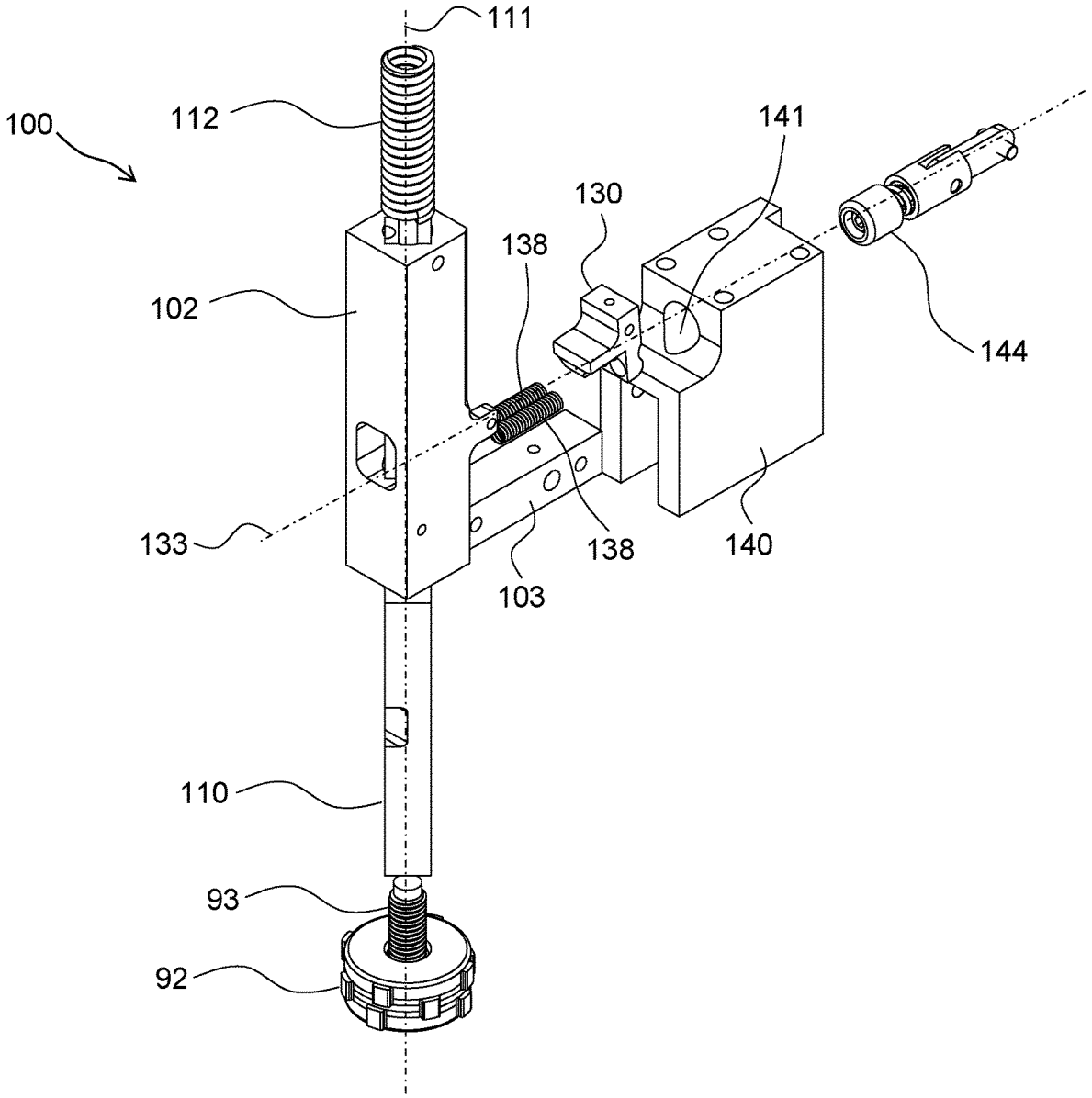
FIG. 11 is an exploded perspective view of the mechanical stabilizer illustrated in FIG. 7.

FIG. 11 is an exploded perspective view of the mechanical stabilizer 100 illustrated in FIG. 7. The leg 110 has a long axis 111 and is movably disposed generally along the long axis 111 within the cavity in the housing 102. The first spring 112 is disposed between the leg 110 and a ceiling of the cavity. The housing 102 has an extension 103 that extends into the piston housing 140. A piston 144 is movably position within a piston opening 141 extending through the piston housing 140 along the longitudinal axis 133 of the piston 144 which intersects the lever portion 132 of the cam 130.

Figure 12:
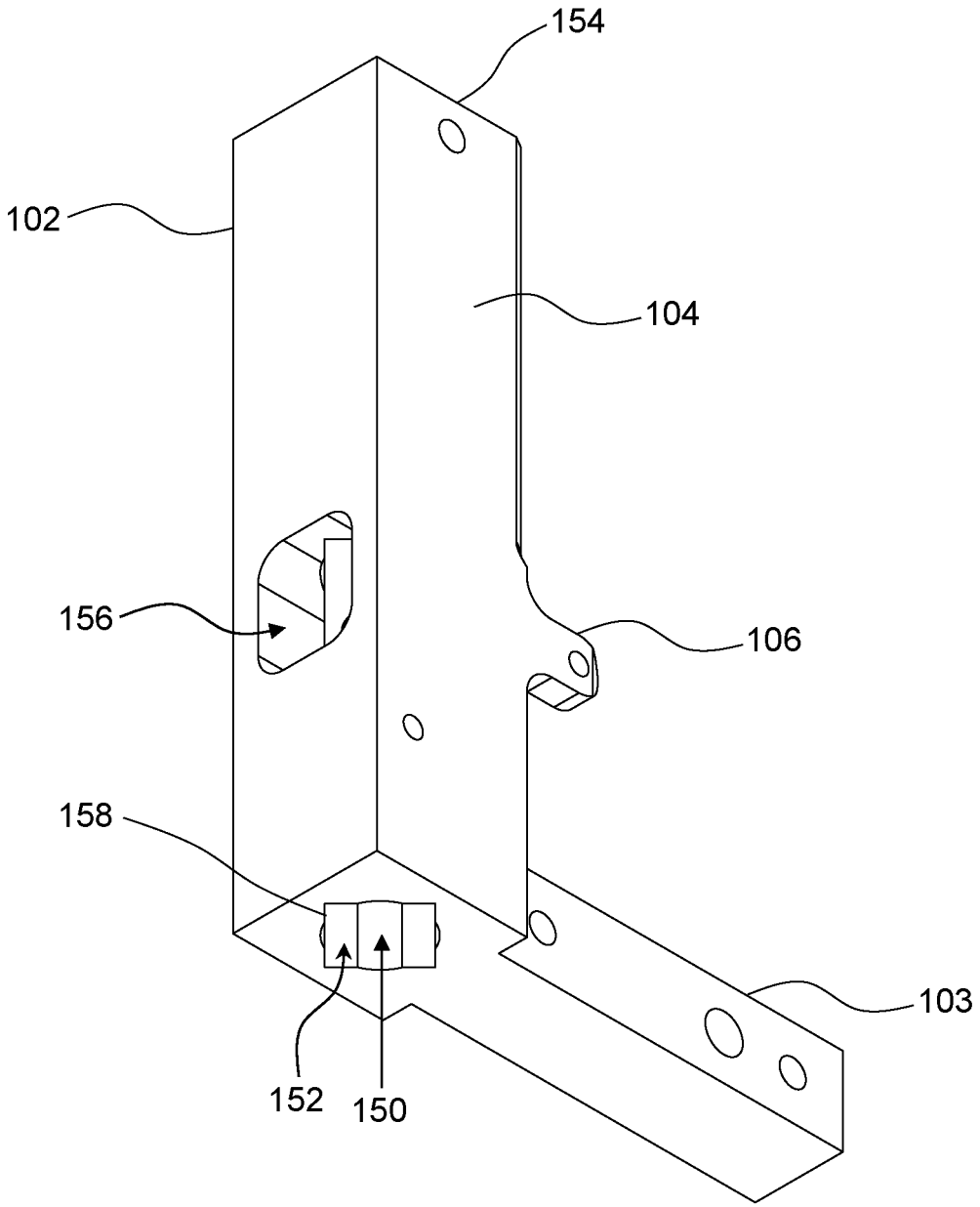
FIG. 12 is a left side bottom perspective view of the housing illustrated in FIG. 11.
Figure 13:
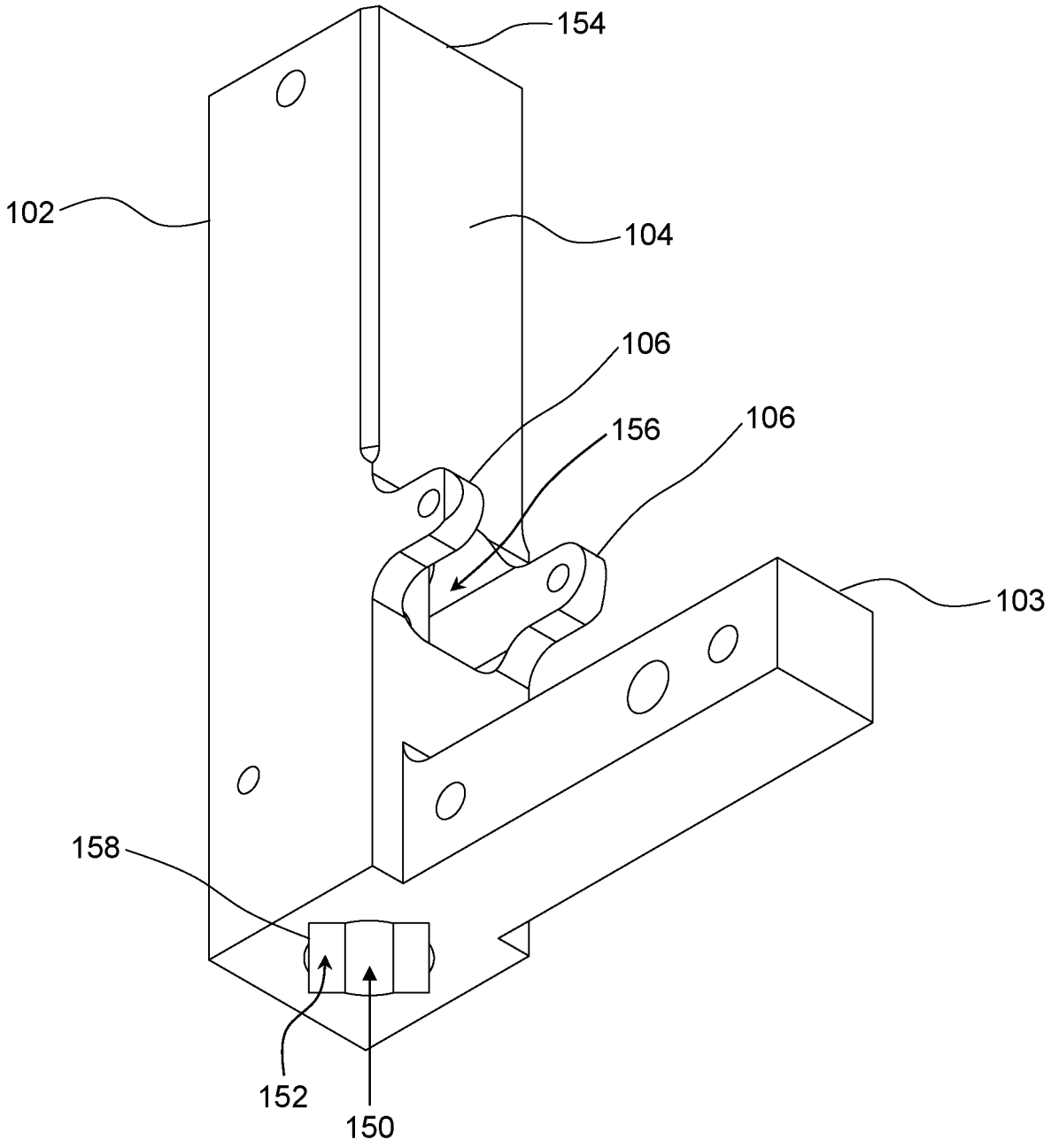
FIG. 13 is a right-side bottom perspective view of the housing illustrated in FIG. 11.

FIGS. 12 and 13 are left side and right-side bottom perspective views of the housing illustrated in FIG. 11. The housing 102 has sidewalls 104, and a cavity 150 configured to receive the leg 110. The leg 110 is slidably positioned within the cavity 150. The cavity 150 has a first opening 152, a ceiling 154 opposite the first opening 152, and at least one cavity sidewall 158 disposed between the ceiling 154 and the first opening 152. The ceiling 154 is disposed superjacent (i.e., lying over or above) to the first opening 152. The cavity 150 includes a second opening 156 disposed between the ceiling 154 and the first opening 152.

The housing 102 includes a housing extension 103 that is positioned within the piston housing 140. The housing 102 further includes a pair of cam attachment points 106 to which the cam 130 is pivotably attached. The engagement portion 134 of the cam 130 is to extend into the second opening 156.

The cavity 150 may be rectangular shaped. A rectangular shaped cavity 150 has four sidewalls 158 extending between the first opening 152 and the ceiling 154. Accordingly, the leg 110 received by the cavity 150 would also be rectangular shaped. A clearance between the cavity 150 and the leg 110 is at least 0.005 inches.

Optionally, the cavity 150 may be circular shaped. A circular shaped cavity 150 has a single sidewall 158 extending between the first opening 152 and the ceiling 154. Accordingly, the leg 110 received by the cavity 150 would also be circular shaped. A circular shape cross section of the cavity 150 has a first diameter, and wherein a circular shape cross section of the leg 110 has a second diameter, with the second diameter being less than the first diameter by at least 0.01 inches.

As yet another option, the cavity 150 may be triangular shaped. A triangular shaped cavity 150 has three sidewalls 158 extending between the first opening 152 and the ceiling 154. Accordingly, the leg 110 received by the cavity 150 would also be triangular shaped.

Figure 14:
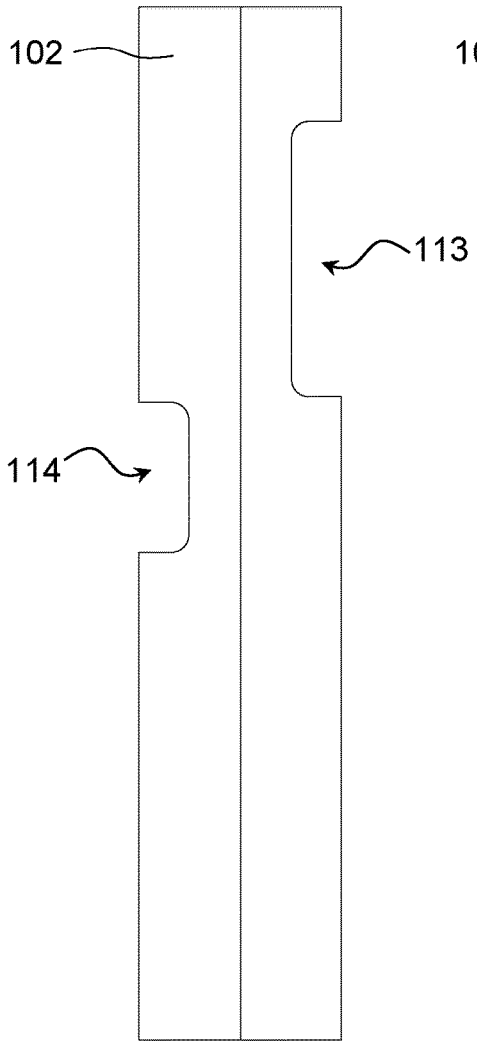
FIG. 14 is a side perspective view of the leg illustrated in FIG. 11.
Figure 15:
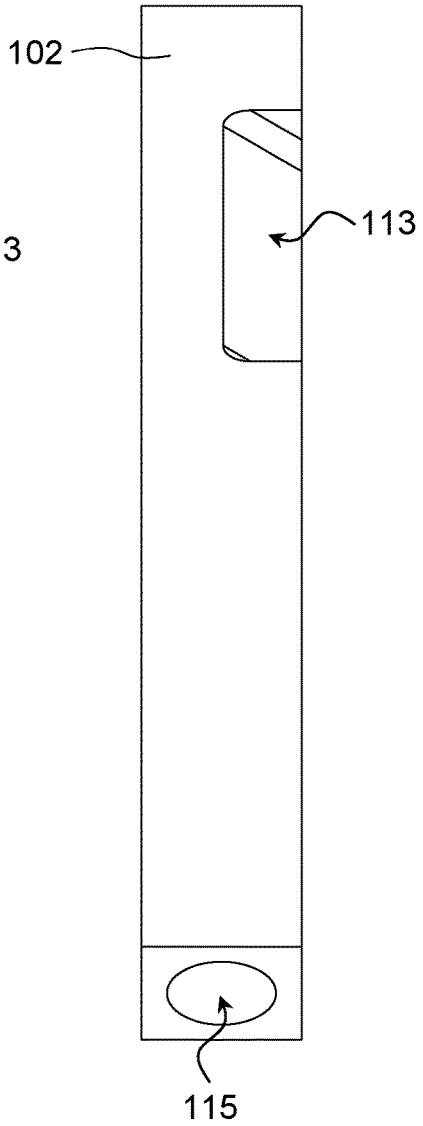
FIG. 15 is a right-side bottom perspective view of the leg illustrated in FIG. 11.
Figure 16:
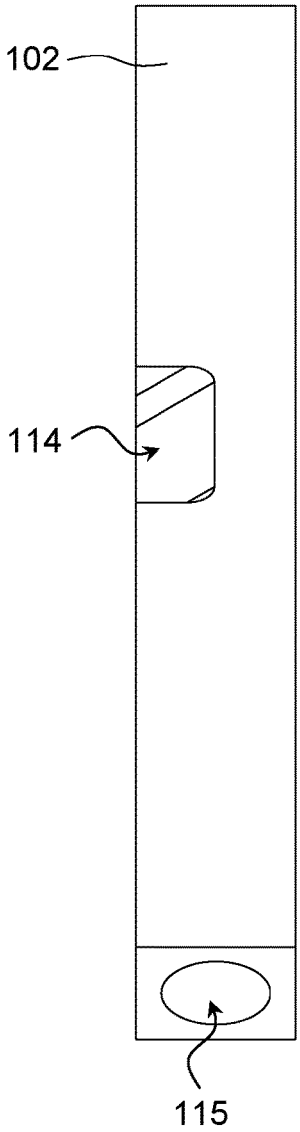
FIG. 16 is a left side bottom perspective view of the leg illustrated in FIG. 11.

FIG. 14 is a side perspective view of the leg 110 illustrated in FIG. 11, and FIGS. 15 and 16 are different bottom perspective views of the leg 110. The leg 110 comprises a first cutout 113 on a front side, a second cutout 114 on an opposing back side, and an opening 115 on the bottom.

As noted above, the leg 110 is configured to move up and down within the cavity 150 in the housing 102. A range of travel of the leg 110 is about 20 mm, and preferably 4 to 5 mm. The first cutout 113 is configured to provide a flat surface that is aligned with the engagement portion 136 of the cam 130. The second cutout 114 is configured to limit the total travel of the leg 110. The opening 115 on the bottom of the leg 110 is for receiving the foot base 92.

As noted above, when the cavity 150 in the housing 102 comprises a rectangular shape, there are four sidewalls 158 in the cavity 150. The leg 110 has a rectangular shape in cross section with respect to horizontal. The leg 110 may be sized so that a clearance between the cavity 150 and the leg 110 is at least 0.005 inches.

Optionally, when the cavity 150 in the housing 102 comprises a circular shape, there is a single sidewall 158 in the cavity 150. The leg 110 has a circular shape in cross section with respect to horizontal. The circular shape cross section of the cavity 150 may comprise a first diameter and the circular shape cross section of the leg 110 may comprise a second diameter, and wherein the second diameter is less than the first diameter by at least 0.01 inches.

As another option, when the cavity 150 in the housing 102 comprises a triangular shape, there are three sidewalls 158 in the cavity 150. The leg 110 has a triangular shape in cross section with respect to horizontal.

Figure 18:
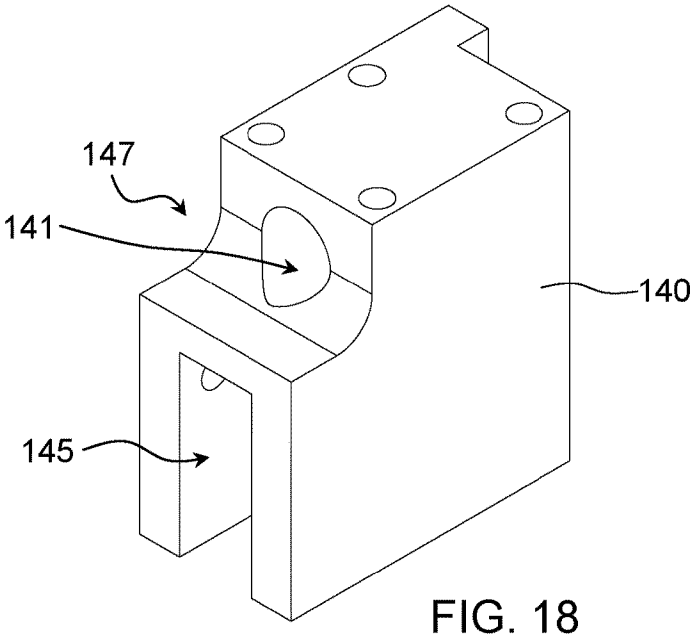
FIG. 18 is a front side perspective view of the piston housing illustrated in FIG. 11.
Figure 19:
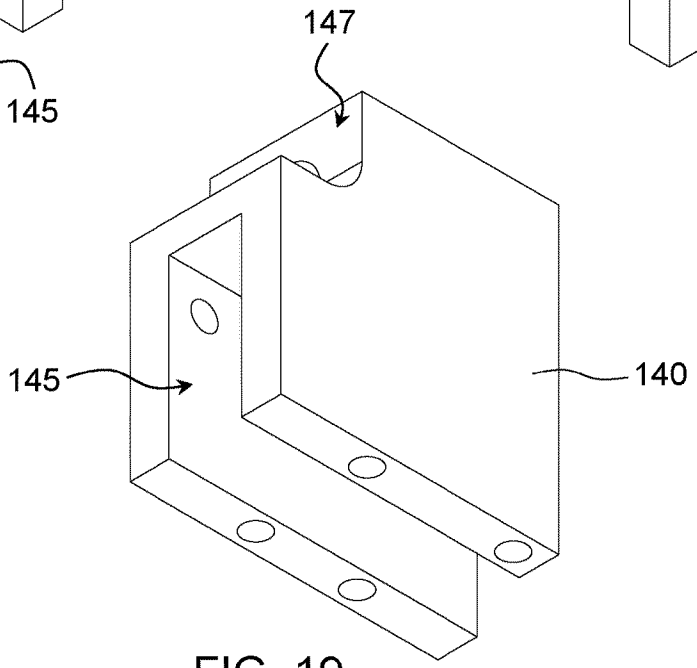
FIG. 19 is a bottom perspective view of the piston housing illustrated in FIG. 11.
Figure 17:
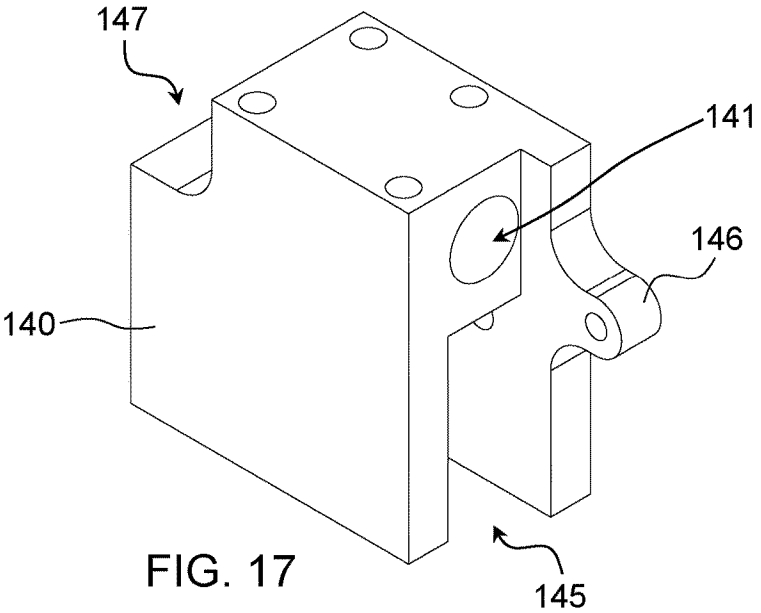
FIG. 17 is a back side perspective view of the piston housing illustrated in FIG. 11.
Figure 20:
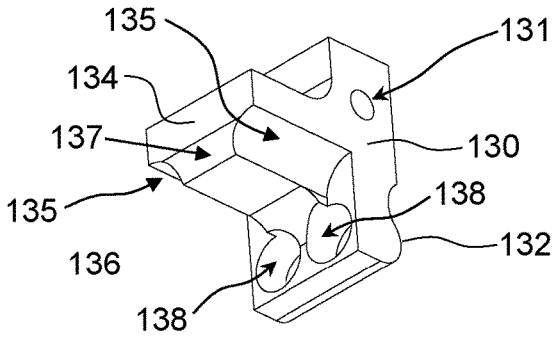
FIG. 20 is a front side bottom perspective view of the cam illustrated in FIG. 11.
Figure 21:
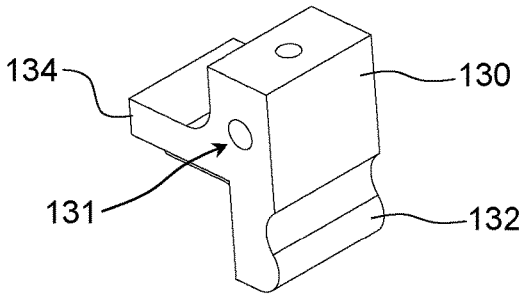
FIG. 21 is a back side upper perspective view of the cam illustrated in FIG. 11.

FIGS. 17-19 are different perspective views of the piston housing 140 illustrated in FIG. 11. The piston housing 140 comprises an opening 145 to receive the housing extension 103 of the housing 102. The opening 145 extends through the piston housing 140 in the same direction as the piston opening 141 which likewise extends through the piston housing 140. The piston opening 141 is configured to receive the piston 144 that is moveably positioned to make contact with the lever portion 132 of the cam 130.

The piston housing 140 comprises an attachment area 146 for piston linkage 210. Movement of the piston linkage 210 moves the piston 144 within the piston opening 141. An upper corner section of the piston housing 140 facing the housing 140 has a curved cutout 147. The cutout 147 provides an interface area for the piston 144 to make contact with the lever portion 132 of the cam 130.

Figure 25:
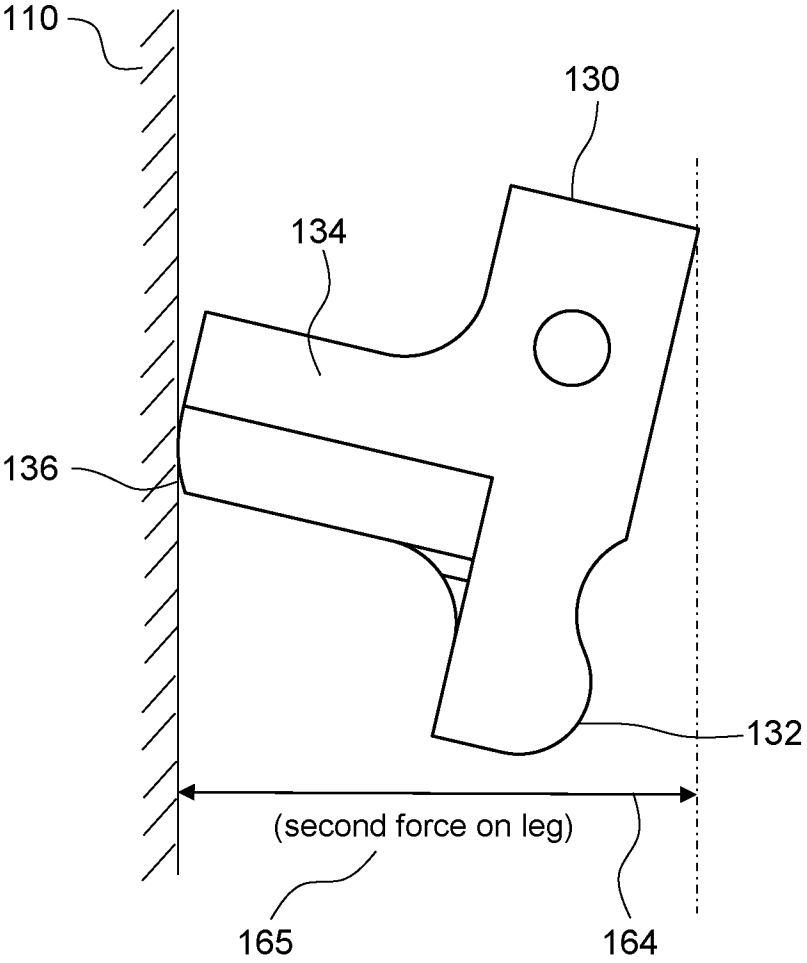
FIG. 25 is an enlarged side view of the cam illustrated in FIG. 10 making contact with the leg in a locked position with a load on the activatable foot.

FIGS. 20-23 are different perspective views of the cam 130 illustrated in FIG. 11, whereas FIGS. 24-25 are enlarged side views of the cam 130 making contact with the leg 110 in in a locked position. The cam 130 comprises an attachment opening 131 so that the cam 130 may be pivotably attached to the housing 102. As noted above, the cam 130 comprises a lever portion 132 and an engagement portion 134, wherein the engagement portion 134 comprises an engagement surface 136. The engagement surface 136 of the cam 130 has a radius defining a curved edge 137 that makes contact with the leg 110 that is moveably positioned within the housing 102. As the cam 130 rotates to the locked position, the effective length of the engagement surface 136 within the second opening 156 in the cavity 150 of the housing 102 changes. The engagement surface 136 has a first effective length 160 corresponding to there being no load on the activable foot 90, and a second effective length 164 corresponding to there being a load on the activable foot 90. The first effective length 160 is disposed superjacent the second effective length 164, and wherein the second effective length 164 is greater than the first effective length 160.

If there is no load on the activable foot 90 as shown in FIG. 24, then a first force 161 corresponding to the first effective length 160 is applied by the cam 130 to the leg 110. This results in the leg 110 being pushed into a cavity sidewall within the housing 102. No load on the activatable foot 90 causes the curved edge 137 of the engagement surface 136 of the cam 130 to make contact with the leg 110 at an upper portion of the curved edge 137 which defines the first effective length 160.

If there is a load on the activable foot 90 as shown in FIG. 25, then a second force 165 corresponding to the second effective length 164 is applied by the cam 130 to the leg 110, where the second force 165 is greater than the first force 161. This also results in the leg 110 being pushed into the cavity sidewall within the housing 102, but the second force 165 pushes the leg 110 further up into the housing 102 as compared to the first force 161. A load on the activatable foot 90 causes the curved edge 137 of the engagement surface 136 of the cam 130 to make contact with the leg 110 at a lower portion of the curved edge 137 which defines the second effective length 164.

The cam 130 comprises a pair of receiving areas 139 for the pair of second springs 138 that extend between the housing 102 and the lever portion 132 of the cam 130. The pair of second springs 138 bias the cam 130 such that the second springs function as release springs for the cam 130 when moving the cam 130 from a locked position to an unlocked position. The engagement portion 134 of the cam 130 comprises a pair of spaced apart cutouts 135. The pair of cutouts 135 further define the radius of the curved edge 137 of the engagement surface 136.

Figure 26:
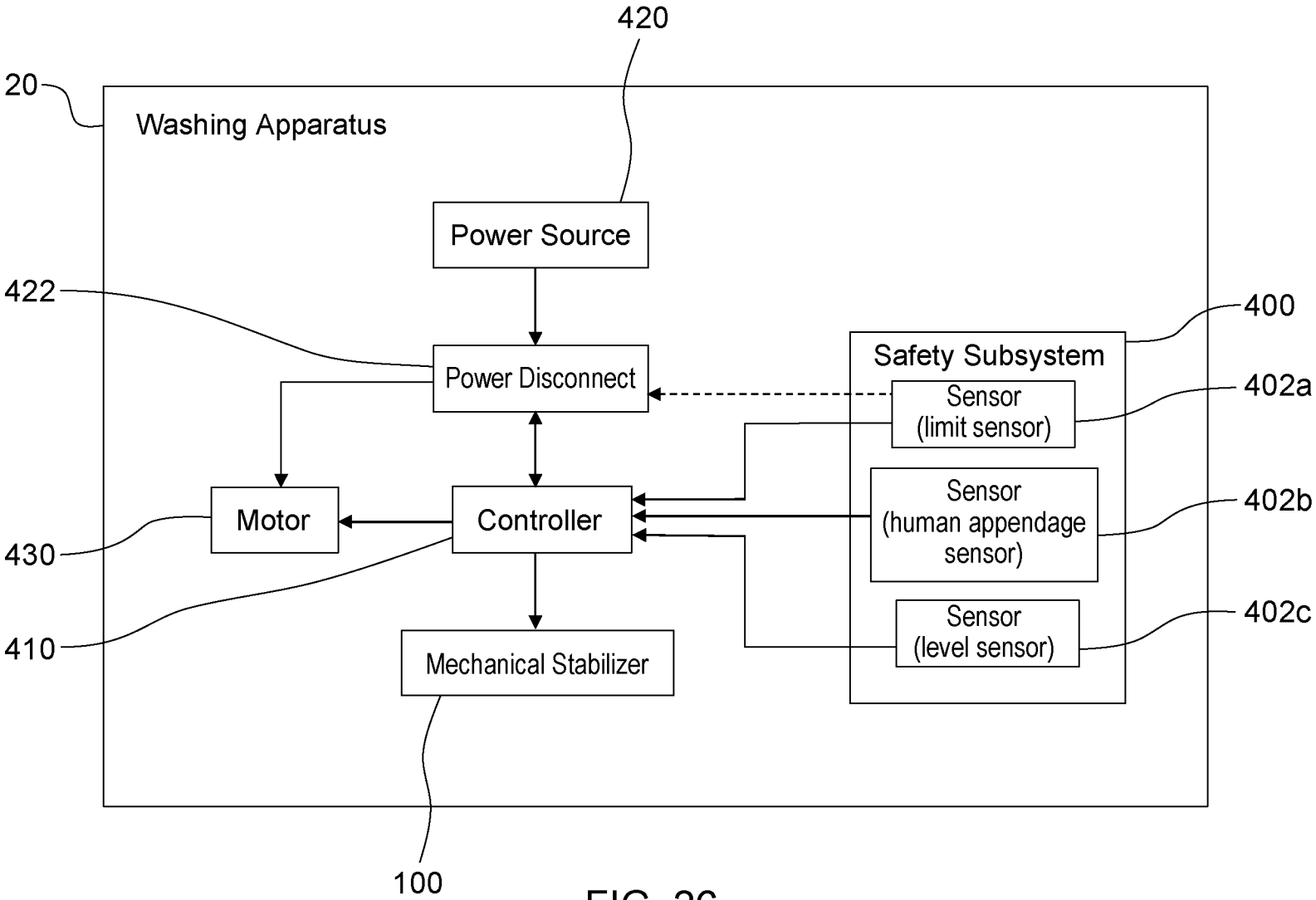
FIG. 26 is a block diagram of a safety subsystem integrated within the washing apparatus illustrated in FIG. 1.

FIG. 26 is a block diagram of a safety subsystem 400 integrated within the washing apparatus 20 illustrated in FIG. 1. The safety subsystem 400 is configured to comply with class B standards directed to home appliances, including the washing apparatus 20. The safety system may comprise at least one sensor, wherein the sensor is in signal communication with a controller such that the safety system can stop an operation of the washing apparatus, preclude the start of an operation of the washing apparatus and/or release and/or retract the activatable foot.

The safety subsystem 400 comprises one or more sensors 402*a*-402*c*, which may constitute either a digital or analog means of controlling the operating state of the washing apparatus 20 with respect to a deployment state of the mechanical stabilizer 100. The one or more sensors 402*a*-402*c* may also be generally referred to as sensors 402. The sensors 402 may be represented by a broad range of sensors such as laser-based proximity sensors, magnetic hall effect sensors, and other means of sensing local machine subsystem element position.

The sensors 402 are coupled to a controller 410 that controls operation of the mechanical stabilizer 100. The controller 410 is also coupled to a power source 420 via a power disconnect 422 within the washing apparatus 20, and to a motor 430 that rotates the drum 54. The power source 420 may be AC and/or DC power providing power to the controller 410 and the motor 430 as well as to other electrical components within the washing apparatus 20.

The deployment state of the mechanical stabilizer 100 corresponds to the first and second pairs of wheels 70, 72 being movable between an engaged position and a retracted position. In the engaged position, the first and second pairs of wheels 70, 72 are engaged (i.e., in contact) with the floor upon which the washing apparatus 20 is placed. This allows the washing apparatus 20 to be easily rolled into position. In the retracted position, the first and second pairs of wheels 70, 72 are spaced from the floor so that the mass 21 of the washing apparatus 20 is level while resting on the at least three feet 80 and the spring-loaded foot 90.

The washing apparatus 20 is not to be operated if the first and second pairs of wheels 70, 72 are not in the retracted position, or if the process of placing the first and second pairs of wheels 70, 72 in the retracted position is obstructed. In addition, the washing apparatus 20 is not to be operated if the washing apparatus 20 is not level with the floor while the first and second pairs of wheels 70, 72 are in the retracted position.

In one example, sensor 402*a* may be one or more limit switches associated with the mechanical stabilizer 100 to sense contact by the at least three feet 80 and the spring-loaded foot 90 with the floor. The limit switches may also sense when the first and second pairs of wheels 70, 72 are in the engaged position or the retracted position. Based on the input received by the controller 410 from the sensor 402*a*, the operating state of the washing apparatus 20 is controlled by the controller 410.

Optionally, sensor 402*a* may be coupled to a power disconnect 422 that includes a mechanical mechanism for physically disconnecting the AC or DC power at the power source 420 to the controller 410 and/or to the motor 430. The sensor 402*a* and the power disconnect 422 serve as a master power disconnect switch for the washing apparatus 20 while coupled to the operating state of the washing apparatus 20. As an alternative to the power disconnect 422, an analog circuit may be used to translate logic from the sensor 402*a* into a mechanical power disconnect action without having the controller 410 in the loop.

In another example, sensor 402*b* may be positioned at a base of the washing apparatus 20 to sense human presence. A safety skirt, for example, may be provided around the base of the washing apparatus 20 so that a human appendage placed under any point around the base will prevent the mechanical stabilizer 100 from placing the first and second pairs of wheels 70, 72 in a retracted position.

In yet another example, sensor 402*c* may be placed within the washing apparatus 20 to sense conditions which may relate to improper stabilization conditions. Sensor 402*c* may be a level sensor, for example, providing feedback to the controller 410. If the washing apparatus 20 is not level or stable while the first and second pairs of wheels 70, 72 are in the retracted position, then the controller will not allow the motor 430 to operate.

VARIOUS EMBODIMENTS WITH REFERENCE TO ALL FIGURES

Having described each figure individually, a non-limiting description of various embodiments of the washing apparatus 20 will now be provided, making reference to all of the figures. The washing apparatus 20 comprises an apparatus base 30, and a housing 102 carried by the apparatus base 30 and having sidewalls 104 extending from the apparatus base 30. The housing 102 comprises a cavity 150 having a first opening 152, a ceiling 154 opposite the first opening 152, and at least one cavity sidewall 158 disposed between the ceiling 154 and the first opening 152. The ceiling 154 is disposed superjacent to the first opening 152. The cavity 150 further comprises s second opening 156 disposed between the ceiling 154 and the first opening 152.

A tub 50 is above the apparatus base 30 and defines a fluid containment envelope 52. A drum 54 is positioned within the tub 50 and is rotatable relative to the tub 50 about an axis of rotation 56 that is within about 20 degrees of horizontal relative to the apparatus base 30. At least three feet 80 are attached to the apparatus base 30 and an activatable foot 90 is disposed opposite the at least three feet 80. The activatable foot 90 comprises a foot base 92 connected to a leg 110, wherein the leg 110 has a long axis 111 and is movably disposed within the cavity 150 generally along the long axis 111. A first spring 112 is disposed between the leg 110 and the ceiling 154 of the cavity 150.

A cam 130 is disposed adjacent to the second opening 156, and is pivotably attached to the housing 102. The cam 130 comprises a lever portion 132 and an engagement portion 134, wherein the engagement portion 134 is pivotably engaged with the second opening 156. The engagement portion 134 comprises a profiled engagement surface 136 such that when engaged under no load on the activatable foot 90, the engagement surface 136 applies a first force 161 to the leg 110 thereby pushing the leg 110 into the at least one cavity sidewall 158. When engaged under load on the activatable foot 90, the engagement surface 136 applies a second force 165 to the leg 110 thereby pushing the leg 110 into the at least one cavity sidewall 158, and wherein the second force is greater than the first force.

A pair of second springs 138 are disposed between the lever portion 132 and the housing 102. The pair of second springs 138 are disposed along the longitudinal axis 133 of the piston 144. The pair of second springs 138 may be used as release springs for the cam 130.

The washing apparatus 20 comprises a mass 21 which provides a downward force 22 toward the floor 23, and wherein the first spring 112 applies a force 116 to the housing 102 that is from between about 40% to about 70% of the downward force 22. The force 116 is constantly being applied by the first spring 112 so that the spring-loaded foot 90 is always being pushed toward the floor 23.

The cam 130 is energized to automatically engage and disengage the leg 110. In particular, the engagement portion 134 comprises a profiled engagement surface 136. The engagement surface 136 has a radius defining a curved edge 137 that makes contact with the leg 110 that is moveably positioned within the housing 102. The engagement surface 136 of the cam 130 has a first effective length 160 and a second effective length 164, wherein the first effective length 160 is disposed superjacent the second effective length 164, and wherein the second effective length 164 is greater than the first effective length 160.

The engagement surface 136 of the cam 130 may be in an unlocked position, as illustrated in FIG. 9, or in a locked position (as illustrated in FIG. 10). The unlocked position of the engagement surface 136 is based on the washing apparatus 20 being stowed away and not in use, whereas the locked position of the engagement surface 136 is based on the washing apparatus 20 being in a room in which it will be used.

As the cam 130 rotates to the locked position, the effective length of the engagement surface 136 within the second opening 156 in the cavity 150 of the housing 102 changes. The engagement surface 136 has a first effective length 160 corresponding to there being no load on the activable foot 90, and a second effective length 164 corresponding to there being a load on the activable foot 90. The second effective length 164 is greater than the first effective length 160. The first effective length 160 results in a first force 161 being applied by the cam 130 to the leg 110, and the second effective length 164 results in a second force 165 being applied by the cam 130 to the leg 110. The second force 165 is greater than the first force 161. Both the first and second forces 161, 165 push the leg 110 into the cavity sidewall within the housing 102, but the second force 165 pushes the leg 110 further up into the housing 102 as compared to the first force 161.

The first and second pairs of wheels 70, 72 may be swivel casters. Optionally, the first and second pairs of wheels 70, 72 may be omni wheels providing omnidirectional movement. Omni wheels comprise a primary axis of rotation and along its circumference may comprise a plurality of rollers which have an axis of rotation generally perpendicular to the primary axis of rotation.

The at least three feet 80 may be adjustable in height with respect to the apparatus base 30. Alternatively, the at least three feet 80 may be fixed in height with respect to the apparatus base 30. That is, the at least three feet 80 are not adjustable.

A range of travel of the leg 110 along its longitudinal axis 111 is about 20 mm, and preferably 4 to 5 mm. The cavity 150 within the housing 103 may be rectangular shaped. A rectangular shaped cavity 150 has four sidewalls 158 extending between the first opening 152 and the ceiling 154. Accordingly, the leg 110 received by the cavity 150 would also be rectangular shaped. A clearance between the cavity 150 and the leg 110 is at least 0.005 inches.

Optionally, the cavity 150 may be circular shaped. A circular shaped cavity 150 has a single sidewall 158 extending between the first opening 152 and the ceiling 154. Accordingly, the leg 110 received by the cavity 150 would also be circular shaped. A circular shape cross section of the cavity 150 has a first diameter, and wherein a circular shape cross section of the leg 110 has a second diameter, with the second diameter being less than the first diameter by at least 0.01 inches.

As yet another option, the cavity 150 may be triangular shaped. A triangular shaped cavity 150 has three sidewalls 158 extending between the first opening 152 and the ceiling 154. Accordingly, the leg 110 received by the cavity 150 would also be triangular shaped.

CONTEMPLATED EXAMPLES

1. A washing apparatus comprising:
   an apparatus base;
   a housing carried by the apparatus base and having sidewalls extending from the apparatus base, wherein the housing comprises a cavity having a first opening, a ceiling opposite the first opening, and at least one cavity sidewall disposed between the ceiling and the first opening, the ceiling being disposed superjacent to the first opening, wherein the cavity comprises s second opening disposed between the ceiling and the first opening;
   a tub above the apparatus base and defining a fluid containment envelope;
   a drum positioned within the tub and rotatable relative to the tub about an axis of rotation that is within about 20 degrees of horizontal relative to the apparatus base;

at least three feet attached to the apparatus base;

an activatable foot disposed opposite the at least three feet, the activatable foot comprising a foot base connected to a leg, the leg having a long axis and being movably disposed within the cavity generally along the long axis, and a first spring disposed between the leg and the ceiling of the cavity;

a cam disposed adjacent to the second opening, the cam pivotably attached to the housing and comprising a lever portion and an engagement portion, wherein the engagement portion is pivotably engaged with the second opening, wherein the engagement portion comprises a profiled engagement surface such that when engaged under no load on the activatable foot, the engagement surface applies a first force to the leg thereby pushing the leg into the at least one cavity sidewall, and when engaged under load on the activatable foot, the engagement surface applies a second force to the leg thereby pushing the leg into the at least one cavity sidewall, and wherein the second force is greater than the first force.

2. The washing apparatus of Example 1, further comprising a second spring disposed between the lever portion and the housing.
3. The washing apparatus of Example 2, wherein the second spring is disposed opposite of a pivot axis of the lever portion.
4. The washing apparatus of any of the Examples 1-3, comprising a mass which provides a downward force toward the floor, and wherein the first spring applies a force to the housing that is from between about 40% to about 70% of the downward force.
5. The washing apparatus of any of the preceding Examples 1-4, wherein the engagement surface has a first effective length corresponding to there being no load on the activable foot and a second effective length corresponding to there being a load on the activable foot, wherein the first effective length is disposed superjacent the second effective length, and wherein the second effective length is greater than the first effective length.
6. The washing apparatus of any of Examples 1-4, wherein the engagement surface comprises a radius.
7. The washing apparatus of any of the preceding Examples 1-6, wherein the at least one cavity sidewall extends from the first opening to the ceiling.
8. The washing apparatus of any of the preceding Examples 1-7, wherein the second opening is disposed generally perpendicular to the first opening.
9. The washing apparatus of any of the preceding Examples 1-8, wherein the cam is pivotably attached to the housing.
10. The washing apparatus of any of the preceding Examples 1-9, wherein the cam is energized to automatically engage and disengage the leg.
11. The washing apparatus of any of the preceding Examples 1-10, further comprising a first pair of wheels operably engaged with the apparatus base, a second pair of wheels opposite the first pair of wheels and operably engaged with the apparatus base, and a third pair of wheels disposed between the first and second pairs of wheels, wherein the first pair of wheels and the second pair of wheels are retractable from an engaged position.
12. The washing apparatus of Example 11, wherein when the first pair of wheels and the second pair of wheels are in the engaged position, the at least three feet are not engaged with the floor.
13. The washing apparatus of any of Examples 11 or 12, wherein when the first pair of wheels and the second pair of wheels are in the retracted position, each of the at least three feet are engaged with floor.
14. The washing apparatus of Example 13, wherein in the retracted position, each of the first pair of wheels and the second pair of wheels are spaced from the floor.
15. The washing apparatus of any of the preceding Examples 1-14, wherein a portion of the at least three feet are adjustable in height with respect to the apparatus base.
16. The washing apparatus of any of the preceding Examples 1-15, wherein a portion of the at least three feet are fixed in height with respect to the apparatus base.
17. The washing apparatus of any of Examples 1-14 and 16, wherein none of the at least three feet are adjustable in height with respect to the apparatus base.
18. The washing apparatus of any of the preceding Examples 1-17, wherein a range of travel of the leg along its longitudinal axis is about 20 mm, preferably 4 to 5 mm.
19. The washing apparatus of any of the preceding Examples 1-18, wherein the at least one cavity sidewall comprises a single sidewall and wherein the cavity comprises a circular shape in cross section with respect to horizontal.
20. The washing apparatus of Example 19, wherein the leg comprises a circular shape cross section with respect to horizontal.
21. The washing apparatus of Example 20, wherein the circular shape cross section of the cavity comprises a first diameter and wherein the circular shape cross section of the leg comprises a second diameter, and wherein the second diameter is less than the first diameter by at least 0.005 inches
22. The washing apparatus of any of Examples 1-18, wherein the at least one cavity sidewall comprises three side walls and wherein the cavity comprises a triangular shape in cross section with respect to horizontal.
23. The washing apparatus of Example 22, wherein the leg comprises a triangular cross section with respect to the horizontal.
24. The washing apparatus of any of the preceding Examples 1-23, wherein a clearance between the cavity and the leg is at least 0.005 inches.
25. The washing apparatus of any of the preceding Examples 1-24, further comprising a pair of center wheels carried by the apparatus base, the pair of center wheels positioned along outer edges of the apparatus base.
26. The washing apparatus of any of the preceding Examples 1-25, further comprising a safety system comprising at least one sensor, wherein the sensor is in signal communication with a controller such that the safety system can stop an operation of the washing apparatus, preclude the start of an operation of the washing apparatus and/or release and/or retract the activatable foot.

FURTHER DEFINITIONS AND CROSS-REFERENCES

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A washing apparatus comprising:

an apparatus base;

a housing carried by the apparatus base and having sidewalls extending from the apparatus base, wherein the housing comprises a cavity having a first opening, a ceiling opposite the first opening, and at least one cavity sidewall disposed between the ceiling and the first opening, the ceiling being disposed superjacent to the first opening, wherein the cavity comprises a second opening disposed between the ceiling and the first opening;

a tub above the apparatus base and defining a fluid containment envelope;

a drum positioned within the tub and rotatable relative to the tub about an axis of rotation that is within 20 degrees of horizontal relative to the apparatus base;

at least three feet attached to the apparatus base;

an activatable foot disposed opposite the at least three feet, the activatable foot comprising a foot base connected to a leg, the leg having a long axis and being movably disposed within the cavity along the long axis, and a first spring disposed between the leg and the ceiling of the cavity;

a cam disposed adjacent to the second opening, the cam pivotably attached to the housing and comprising a lever portion and an engagement portion, wherein the engagement portion is pivotably engaged with the second opening, wherein the engagement portion comprises a profiled engagement surface such that when engaged under no load on the activatable foot, the engagement surface applies a first force to the leg thereby pushing the leg into the at least one cavity sidewall, and when engaged under load on the activatable foot, the engagement surface applies a second force to the leg thereby pushing the leg into the at least one cavity sidewall, and wherein the second force is greater than the first force.

2. The washing apparatus of claim 1, further comprising a second spring disposed between the lever portion and the housing.

3. The washing apparatus of claim 2, wherein the second spring is disposed opposite of a pivot axis of the lever portion.

4. The washing apparatus of claim 1, comprising a mass which provides a downward force toward the floor, and wherein the first spring applies a force to the housing that is from between 40% to 70% of the downward force.

5. The washing apparatus of claim 1, wherein the engagement surface has a first effective length corresponding to there being no load on the activatable foot and a second effective length corresponding to there being a load on the activatable foot, wherein the first effective length is disposed superjacent the second effective length, and wherein the second effective length is greater than the first effective length.

6. The washing apparatus of any of claim 1, wherein the engagement surface comprises a radius.

7. The washing apparatus of claim 1, wherein the at least one cavity sidewall extends from the first opening to the ceiling.

8. The washing apparatus of claim 1, wherein the second opening is disposed generally perpendicular to the first opening.

9. The washing apparatus of claim 1, wherein the cam is pivotably attached to the housing.

10. The washing apparatus of claim 1, wherein the cam is energized to automatically engage and disengage the leg.

11. The washing apparatus of claim 1, further comprising a first pair of first wheels operably engaged with the apparatus base, a second pair of second wheels opposite the first pair of wheels and operably engaged with the apparatus base, wherein the first pair of wheels and the second pair of wheels are retractable from an engaged position, and wherein the first pair of wheels and the second pair of wheels are joined together via at least one linkage.

12. The washing apparatus of claim 11, wherein when the first pair of wheels and the second pair of wheels are in the engaged position, the at least three feet are not engaged with the floor.

13. The washing apparatus of claim 11, wherein when the first pair of wheels and the second pair of wheels are in the retracted position, each of the at least three feet are engaged with floor.

14. The washing apparatus of claim 13, wherein in the retracted position, each of the first pair of wheels and the second pair of wheels are spaced from the floor.

15. The washing apparatus of claim 1, wherein a portion of the at least three feet are adjustable in height with respect to the apparatus base.

16. The washing apparatus of claim 1, wherein a range of travel of the leg along its longitudinal axis is 20 mm.

17. The washing apparatus of claim 1, wherein the cavity comprises a circular shape in cross section with respect to horizontal, wherein the leg comprises a circular shape cross section with respect to horizontal, wherein the circular shape cross section of the leg comprises a second diameter, and wherein the second diameter is less than the first diameter by at least 0.005 inches.

18. The washing apparatus of claim 1, wherein the at least one cavity sidewall comprises three side walls and wherein the cavity comprises a triangular shape in cross section with respect to horizontal, wherein the leg comprises a triangular cross section with respect to the horizontal, and wherein a clearance between the cavity and the leg is at least 0.005 inches.

19. The washing apparatus of claim 1, further comprising a pair of center wheels carried by the apparatus base, the pair of center wheels positioned along outer edges of the apparatus base and are off from a symmetry plane of the washing apparatus, wherein the center wheels have a fixed rotational axis with respect to the base.

20. The washing apparatus of claim 1, further comprising a safety system comprising at least one sensor, wherein the sensor is in signal communication with a controller such that the safety system can stop an operation of the washing apparatus, preclude the start of an operation of the washing apparatus and/or release and/or retract the activatable foot.

* * * * *